US010374327B2

(12) United States Patent
Saito et al.

(10) Patent No.: US 10,374,327 B2
(45) Date of Patent: Aug. 6, 2019

(54) ELECTRIC WIRE WITH TERMINAL AND MANUFACTURING METHOD OF ELECTRIC WIRE WITH TERMINAL

(71) Applicant: Yazaki Corporation, Tokyo (JP)

(72) Inventors: Hideki Saito, Shizuoka (JP); Hidehiko Iwasawa, Shizuoka (JP); Masayoshi Takayanagi, Shizuoka (JP); Kei Sato, Shizuoka (JP); Junya Shinohara, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/782,604

(22) Filed: Oct. 12, 2017

(65) Prior Publication Data

US 2018/0109009 A1 Apr. 19, 2018

(30) Foreign Application Priority Data

Oct. 13, 2016 (JP) ..... 2016-201871
Jul. 11, 2017 (JP) ..... 2017-135454

(51) Int. Cl.
*H01R 4/10* (2006.01)
*H01R 4/18* (2006.01)
(Continued)

(52) U.S. Cl.
CPC ..... *H01R 4/18* (2013.01); *H01R 4/184* (2013.01); *H01R 4/185* (2013.01); *H01R 4/62* (2013.01);
(Continued)

(58) Field of Classification Search
CPC ..... H01R 4/185; H01R 4/188; H01R 4/18; H01R 43/048
(Continued)

(56) References Cited

U.S. PATENT DOCUMENTS 3,955,044 A * 5/1976 Hoffman ..... H01R 4/203 174/84 C
3,990,143 A * 11/1976 Dittmann ..... H01R 4/188 29/865
(Continued)

FOREIGN PATENT DOCUMENTS

CN 103069660 A 4/2013
CN 105846275 A 8/2016
(Continued)

OTHER PUBLICATIONS

Chinese Office Action for the related Chinese Patent Application No. 201710943302.6 dated Feb. 2, 2019.
(Continued)

*Primary Examiner* — Hae Moon Hyeon
(74) *Attorney, Agent, or Firm* — Kenealy Vaidya LLP

(57) ABSTRACT

An electric wire with a terminal includes an electric wire, and a crimping terminal including an electric wire connection portion crimped by being wound around a core and a cover of the electric wire, a diameter expansion portion which contains a water stop member covering a tip end portion of the core and sealing a gap between the core and the electric wire connection portion is provided in an end portion of the electric wire connection portion on a tip end side of the core, and a sectional area of the diameter expansion portion is greater than a sectional area at a portion on the base end side of the core with respect to the diameter expansion portion.

3 Claims, 24 Drawing Sheets

(51) Int. Cl.

| | |
|---|---|
| ***H01R 4/62*** | (2006.01) |
| ***H01R 4/70*** | (2006.01) |
| ***H01R 43/00*** | (2006.01) |
| ***H01R 43/048*** | (2006.01) |
| ***H01R 43/055*** | (2006.01) |
| ***H01R 43/058*** | (2006.01) |
| ***H01R 13/52*** | (2006.01) |

(52) U.S. Cl.
CPC ..... *H01R 4/70* (2013.01); *H01R 13/5216* (2013.01); *H01R 43/005* (2013.01); *H01R 43/0488* (2013.01); *H01R 43/055* (2013.01); *H01R 43/058* (2013.01); *H01R 13/52* (2013.01)

(58) Field of Classification Search
USPC ..... 439/878, 877
See application file for complete search history.

(56) References Cited

U.S. PATENT DOCUMENTS

| | | | | |
|---|---|---|---|---|
| 4,828,516 | A * | 5/1989 | Shaffer | H01R 43/058 29/863 |
| 7,174,633 | B2 * | 2/2007 | Onuma | H01R 4/04 29/854 |
| 8,342,894 | B2 * | 1/2013 | Uchiyama | H01R 43/048 439/882 |
| 9,391,384 | B2 * | 7/2016 | Kodama | H01R 4/62 |
| 2010/0035485 | A1 * | 2/2010 | Okamura | H01R 4/185 439/877 |
| 2010/0230160 | A1 * | 9/2010 | Ono | H01R 4/185 174/84 C |
| 2010/0248559 | A1 * | 9/2010 | Fukase | H01R 4/185 439/878 |
| 2013/0095708 | A1 | 4/2013 | Mitose et al. | |
| 2013/0126234 | A1 * | 5/2013 | Ono | H01R 4/72 174/75 R |
| 2015/0140202 | A1 * | 5/2015 | Sato | H01R 4/185 427/58 |
| 2016/0028167 | A1 * | 1/2016 | Hanazaki | H01R 4/184 439/877 |
| 2016/0248212 | A1 * | 8/2016 | Schmidt | H01R 43/048 |
| 2017/0346198 | A1 * | 11/2017 | Chadbourne | H01R 4/183 |

FOREIGN PATENT DOCUMENTS

| | | | | |
|---|---|---|---|---|
| JP | 7-14658 | A | 1/1995 | |
| JP | 2010-40361 | A | 2/2010 | |
| JP | 2010-56020 | A | 3/2010 | |
| JP | 2012-198998 | A | 10/2012 | |
| JP | 2014-164912 | A | 9/2014 | |
| JP | 2015076238 | A * | 4/2015 | H01R 43/048 |
| JP | 2016-184512 | A | 10/2016 | |
| JP | 2017-84485 | A | 5/2017 | |
| WO | 2011/122622 | A1 | 10/2011 | |

OTHER PUBLICATIONS

Japanese Office Action for the related Japanese Patent Application No. 2017-135454 dated Apr. 23, 2019.

* cited by examiner

ELECTRIC WIRE WITH TERMINAL AND MANUFACTURING METHOD OF ELECTRIC WIRE WITH TERMINAL

CROSS-REFERENCE TO RELATED APPLICATION(S)

The present application claims priority to and incorporates by reference the entire contents of Japanese Patent Application No. 2016-201871 filed in Japan on Oct. 13, 2016 and Japanese Patent Application No. 2017-135454 filed in Japan on Jul. 11, 2017.

BACKGROUND OF THE INVENTION

1. Field of the Invention

The present invention relates to an electric wire with terminal, a manufacturing method of an electric wire with a terminal, and a terminal crimping apparatus.

2. Description of the Related Art

In the related art, there are a crimping terminal crimped with respect to a core of an electric wire, and a terminal crimping apparatus crimping the crimping terminal with respect to the electric wire. As an example of the crimping terminals, in WO 2011/122622 A, a technology of a crimping terminal including a barrel piece configuring a crimping unit crimping an exposed portion of an electric wire conductor, exposed with a predetermined length by a tip end of a covered body in a covered electric wire in which an outer circumference of the electric wire conductor is covered with an insulating covered body, on both sides in a width direction, is disclosed in which the barrel piece is formed to have a length in a longitudinal direction which is longer than a length of the exposed portion of the electric wire conductor, a water stop unit is provided at least on a part of a surface of the crimping unit, and the crimping unit is crimped by the barrel piece to continuously and integrally surround a portion from a tip end side from a tip end of the electric wire conductor to a rear end side from the tip end of the covered body.

In Japanese Patent Application Laid-open No. 2017-84485, a technology of an electric wire with a terminal is disclosed in which a crimping unit includes a cover crimping unit crimping a covered portion of a covered conductive wire, a conductive wire crimping unit crimping a conductive wire exposed from the covered portion, and a sealing portion on a terminal main body side from the conductive wire crimping unit, and a compression height of the sealing portion is higher than a compression height of the conductive wire crimping unit.

Here, from the viewpoint of suppressing a performance degradation of the electric wire with a terminal, there is still room for improvement. For example, in a case where the core of the electric wire or a water stop member protrudes to the outside from the crimping terminal due to a pressure at the time of crimping, there is a case where electric performance or sealing properties decrease. In the crimping terminal including the water stop member, in a case where the protruding water stop member is attached to a metal mold, the sealing properties easily decrease. Alternatively, in a case where an elongation amount of the crimping terminal increases at the time of crimping, there is a possibility that the performance of the electric wire with a terminal varies.

SUMMARY OF THE INVENTION

An object of the present invention is to provide an electric wire with a terminal which is capable of suppressing a performance degradation, a manufacturing method of an electric wire with a terminal, and a terminal crimping apparatus.

An electric wire with a terminal according to one aspect of the present invention includes an electric wire; and a crimping terminal including an electric wire connection portion crimped by being wound around a core and a cover of the electric wire, wherein a diameter expansion portion is provided in an end portion of the electric wire connection portion on a tip end side of the core, and a sectional area of the electric wire connection portion at the diameter expansion portion is greater than a sectional area of the electric wire connection portion at a portion on a base end side of the core with respect to the diameter expansion portion.

A method for manufacturing an electric wire with a terminal according to another aspect of the present invention includes a crimping step of crimping an electric wire connection portion of a crimping terminal by interposing the electric wire connection portion and an electric wire between a first metal mold and a second metal mold including a concave portion and by winding the electric wire connection portion around a core and a cover of the electric wire, wherein in the crimping step, the electric wire connection portion is crimped with respect to the electric wire by the second metal mold including a diameter expansion portion in an end portion of the concave portion on a tip end side of the core, and a plane portion in which the diameter expansion portion faces the first metal mold.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, an electric wire with a terminal, a manufacturing method of an electric wire with a terminal, and a terminal crimping apparatus according to embodiments of the present invention will be described in detail with reference to the drawings. Furthermore, the present invention is not limited by the embodiments. In addition, the constituents of the following embodiments include constituents which can be easily conceived by a person skilled in the art or substantially the same constituents.

EMBODIMENTS

Figure 12:
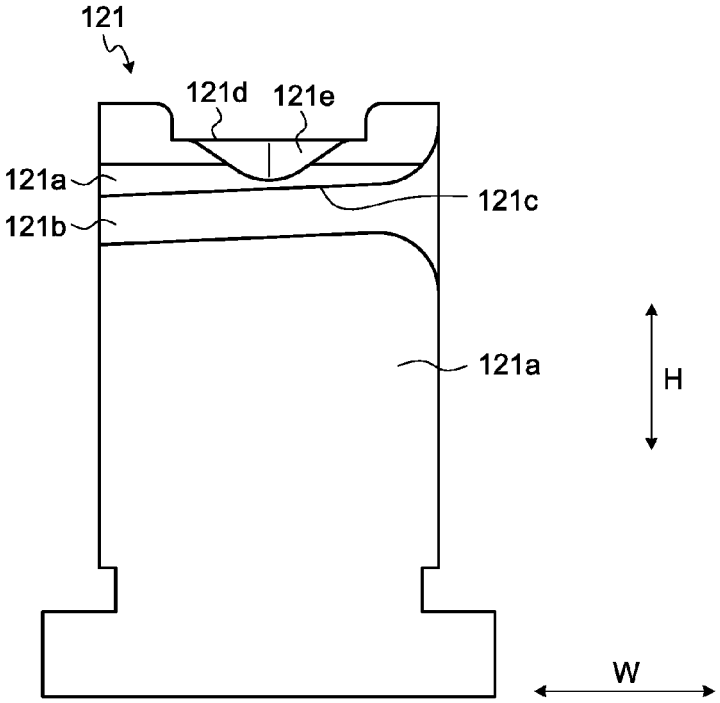
FIG. 12 is a rear view illustrating the terminal cutting body according to the embodiment.
Figure 13:
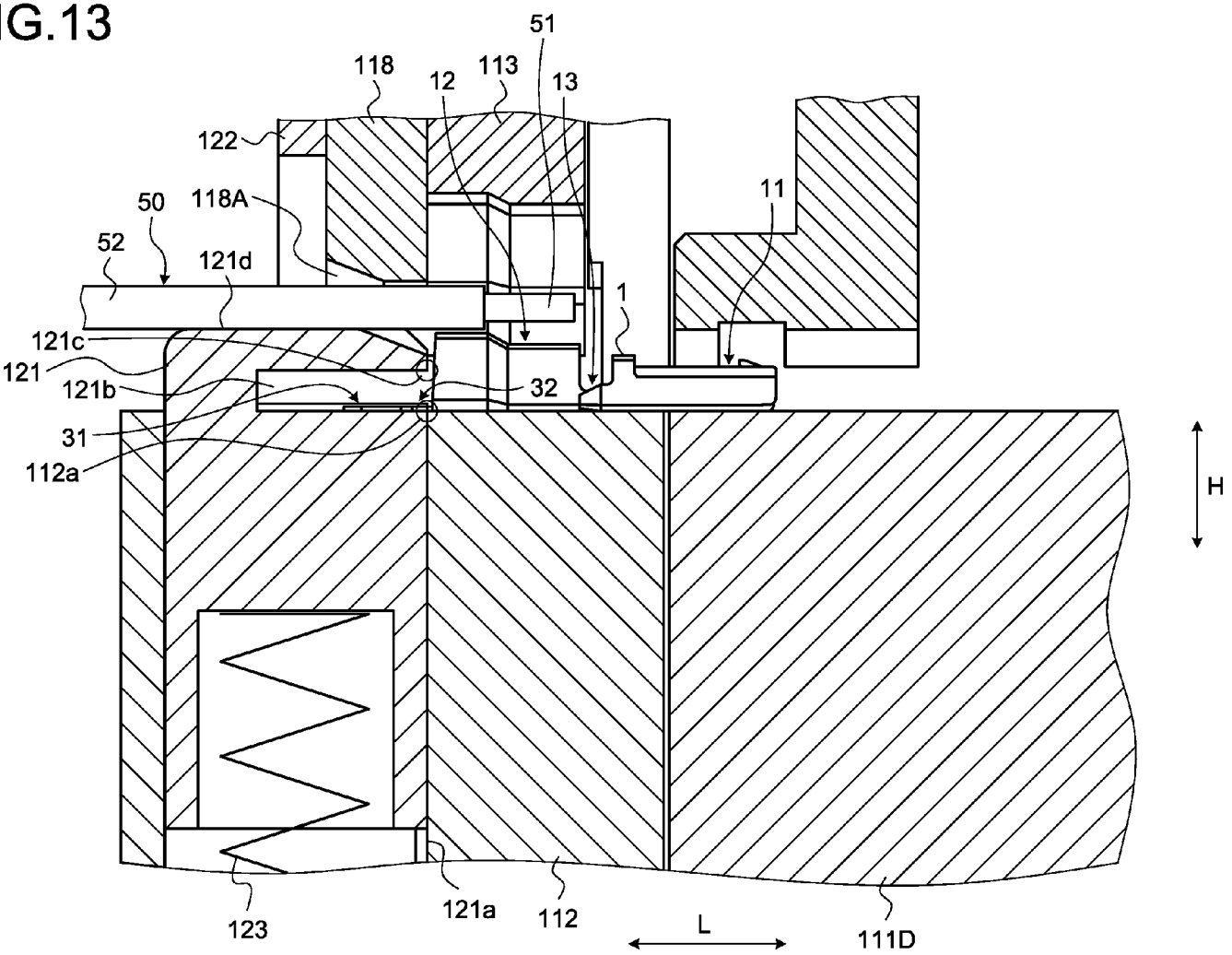
FIG. 13 is a sectional view illustrating a state in which an electric wire and a crimping terminal are set in the terminal crimping apparatus of the embodiment.
Figure 14:
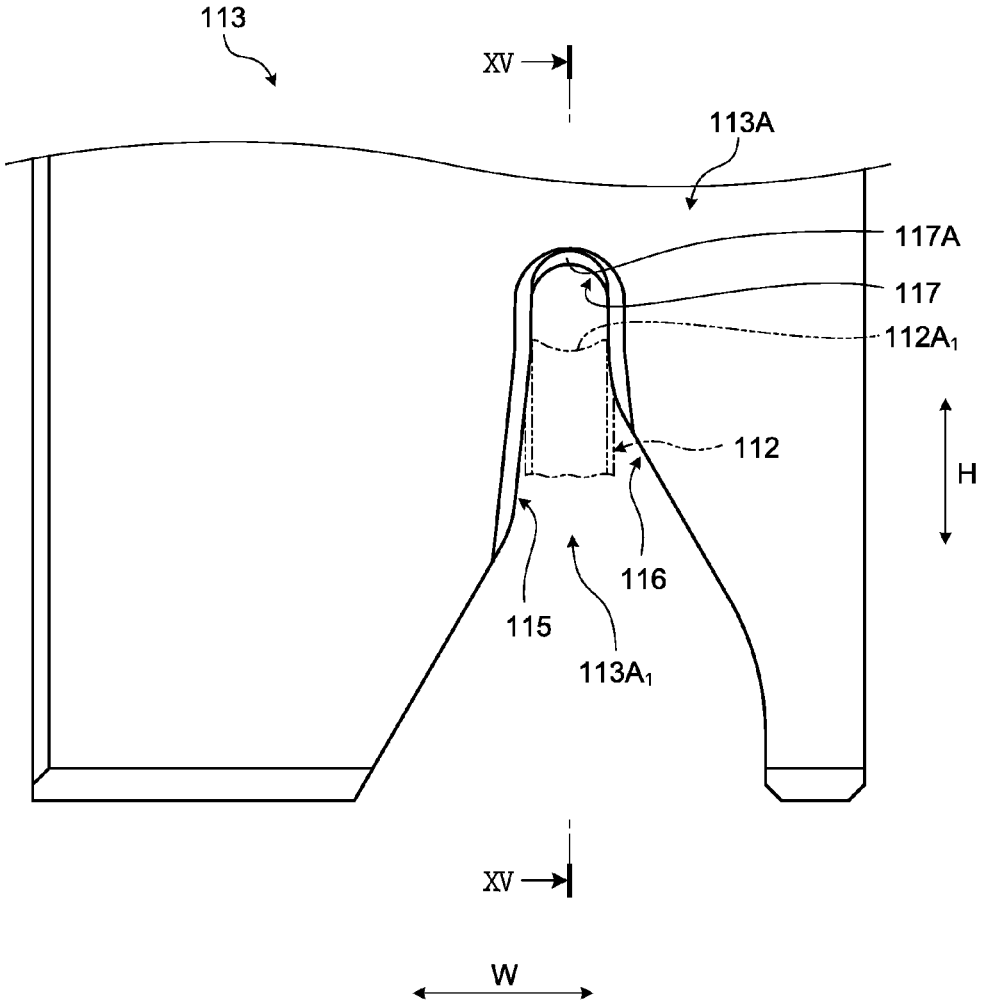
FIG. 14 is a front view illustrating the second metal mold according to the embodiment.
Figure 15:
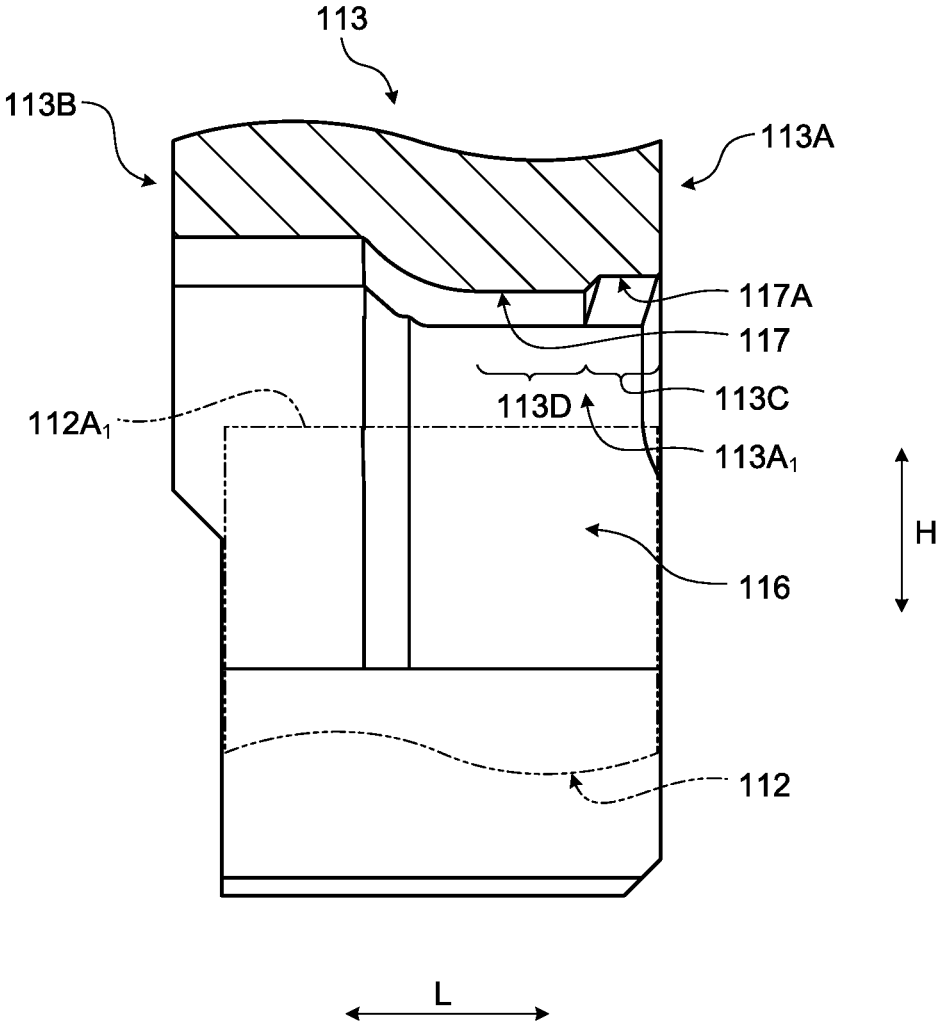
FIG. 15 is a sectional view of the second metal mold according to the embodiment.
Figure 17:
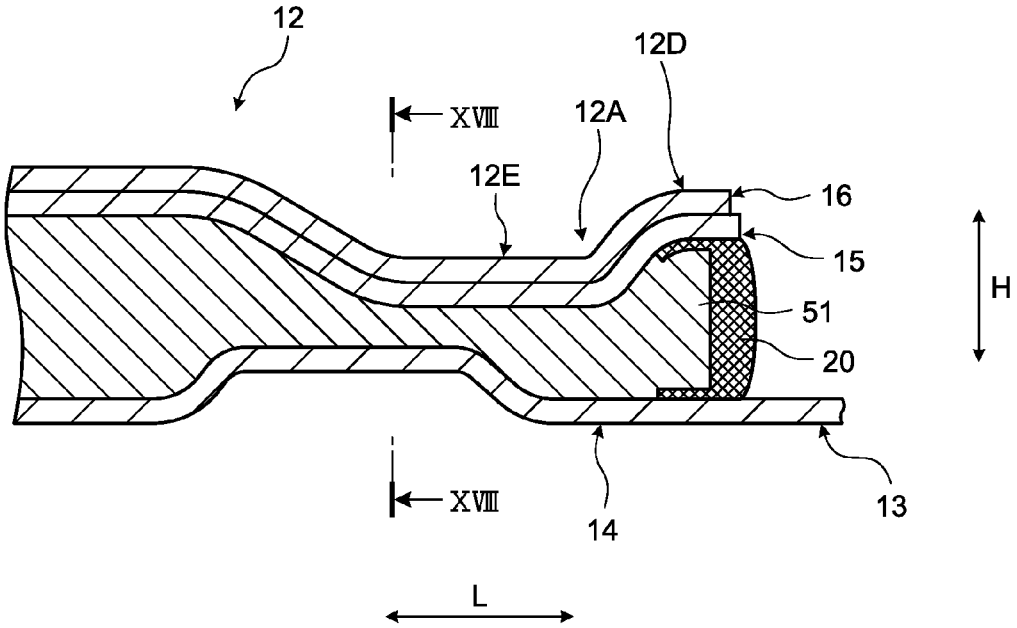
FIG. 17 is a vertical sectional view of the electric wire connection portion according to the embodiment after being crimped.
Figure 18:
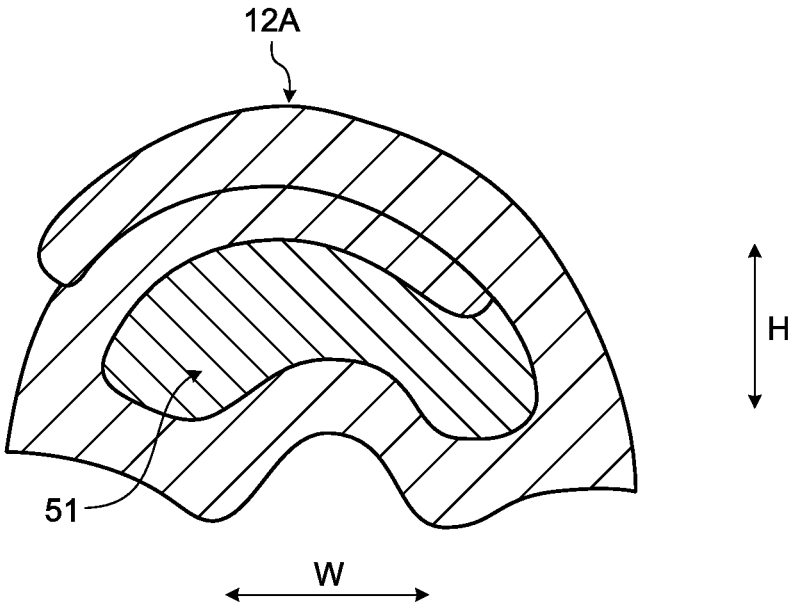
FIG. 18 is a horizontal sectional view of the electric wire connection portion according to the embodiment after being crimped.

Embodiments will be described with reference to FIG. 1 to FIG. 21. This embodiment relates to an electric wire with a terminal, a manufacturing method of an electric wire with a terminal, and a terminal crimping apparatus. Furthermore, FIG. 13 illustrates a sectional surface taken along line XIII-XIII of FIG. 9. FIG. 15 illustrates a sectional surface taken along line XV-XV of FIG. 14. FIG. 18 illustrates a sectional surface taken along line XVIII-XVIII of FIG. 17.

First, a crimping terminal 1 according to this embodiment will be described. The crimping terminal 1 illustrated in FIG. 1 or the like is a terminal crimped with respect to an electric wire 50. The crimping terminal 1 is electrically connected to a counterpart terminal (not illustrated) in a state of being integrated with the electric wire 50. In the electric wire 50 which is a crimping target, a cover 52 in an end portion is removed, and thus, a core 51 is exposed by a predetermined length. The core 51 may be an aggregation of a plurality of strands, or may be a single wire such as a coaxial cable. The crimping terminal 1 is electrically connected to the exposed core 51 by being crimped to the end portion of the electric wire 50.

The crimping terminal 1 includes a terminal clasp 10 and a water stop member 20. The terminal clasp 10 is a main portion of the crimping terminal 1. The terminal clasp 10 is formed of a conductive metal plate (for example, a copper plate and a copper alloy plate) as a base material. The terminal clasp 10 is formed into a predetermined shape which can be connected to the counterpart terminal or the electric wire 50 by punching processing, bending processing, or the like with respect to the base material. The terminal clasp 10 includes a terminal connection portion 11 and an electric wire connection portion 12. The terminal connection portion 11 is a portion which is electrically connected to the counterpart terminal. The electric wire connection portion 12 is a portion which is crimped with respect to the electric wire 50, and is electrically connected to the core 51. A joining portion 13 is between the terminal connection portion 11 and the electric wire connection portion 12. In other words, the terminal connection portion 11 and the electric wire connection portion 12 are joined together through the joining portion 13. The joining portion 13 includes side walls 13*a* and 13*a* joining side walls 11*a* and 11*a* of the terminal connection portion 11 and barrel piece portions 15 and 16, which are side walls of the electric wire connection portion 12, together. One side wall 13*a* joins one side wall 11*a* and the first barrel piece portion 15 together, and the other side wall 13*a* joins the other side wall 11*a* and the second barrel piece portion 16 together. The height of the side wall 13*a* is lower than the height of the barrel piece portions 15 and 16 or the side wall 11*a*. More specifically, the height of the side wall 13*a* decreases towards the electric wire connection portion 12 from the terminal connection portion 11.

The terminal clasp 10 may be a male terminal or a female terminal. In a case where the terminal clasp 10 is the male terminal, the terminal connection portion 11 is molded in a male die, and in a case where the terminal clasp 10 is the female terminal, the terminal connection portion 11 is molded in a female die.

In the description of the crimping terminal 1, a connection direction of the counterpart terminal, that is, an insertion direction of the counterpart terminal will be referred to as a first direction L. The first direction L is a longitudinal direction of the crimping terminal 1. A parallel arrangement direction of the crimping terminal 1 will be referred to as a second direction W. The parallel arrangement direction is a direction in which the crimping terminals 1 are disposed in parallel in a terminal chain body 30 as described below, and is a width direction of the crimping terminal 1. In the crimping terminal 1, a direction orthogonal to both of the first direction L and the second direction W will be referred to as a third direction H. The third direction H is a height direction of the crimping terminal 1.

Figure 1:
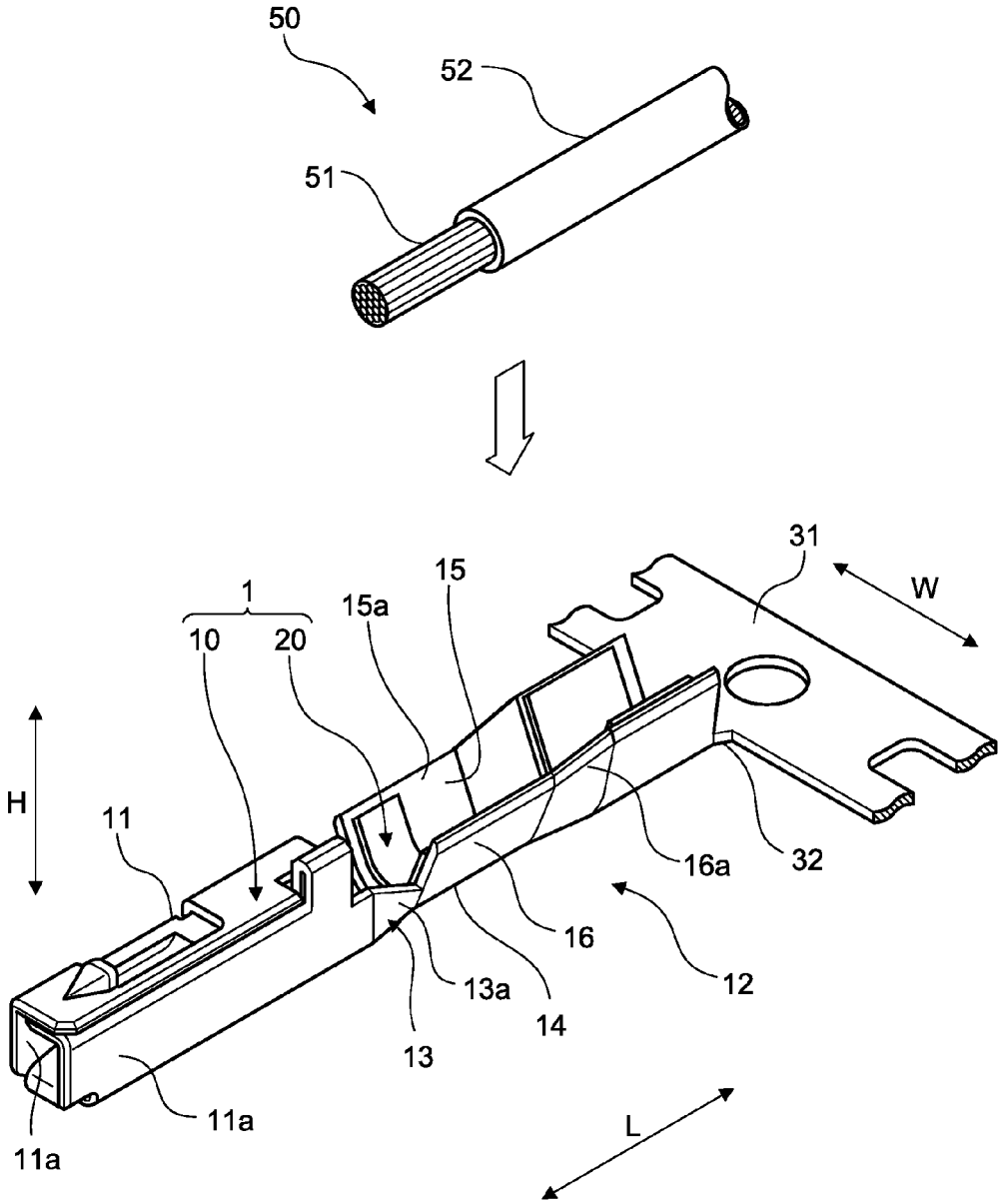
FIG. 1 is a perspective view illustrating a state of a crimping terminal according to an embodiment before being crimped.
Figure 2:
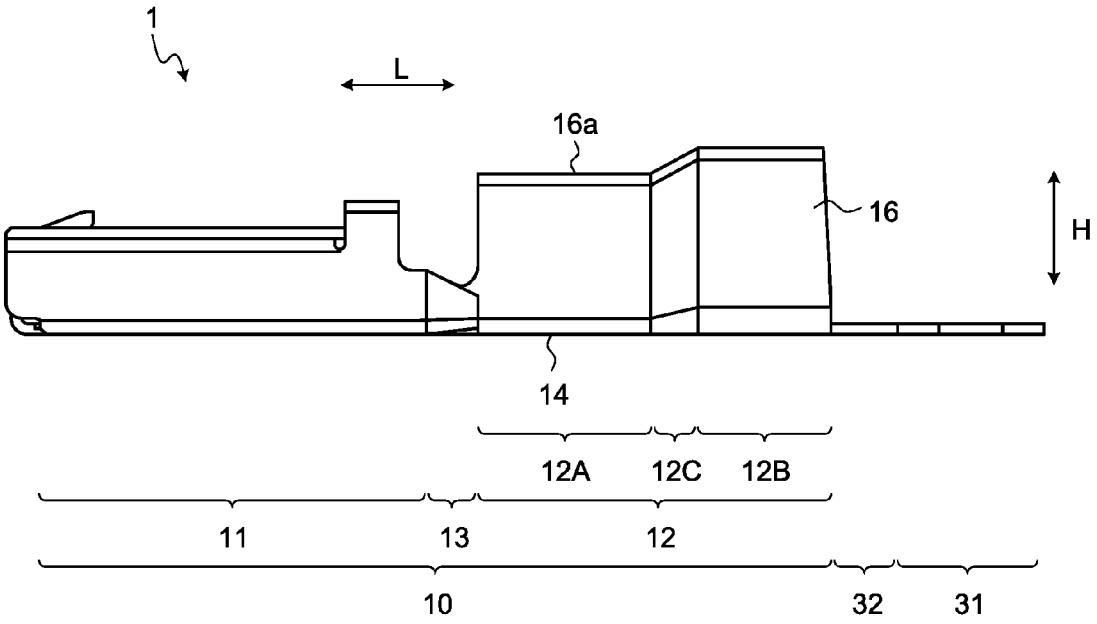
FIG. 2 is a side view illustrating the state of the crimping terminal according to the embodiment before being crimped.
Figure 3:
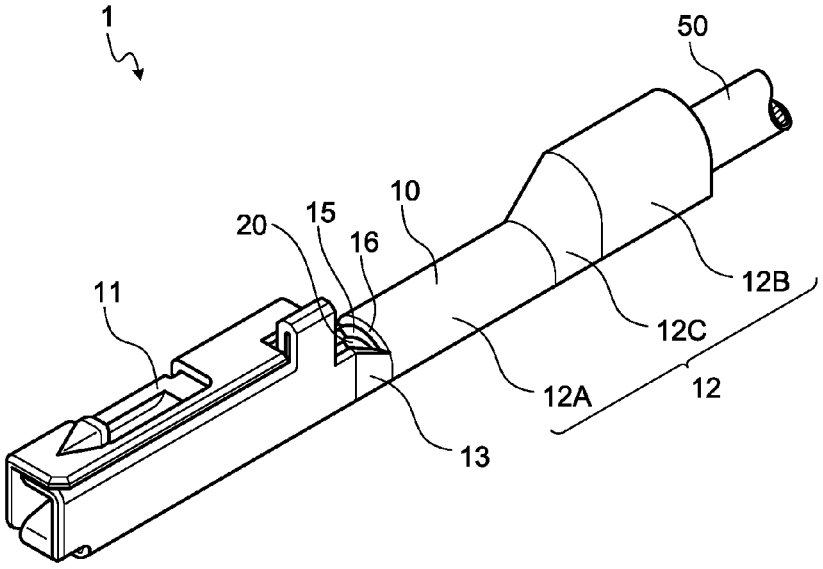
FIG. 3 is a perspective view illustrating the crimping terminal according to the embodiment after being crimped.
Figure 4:
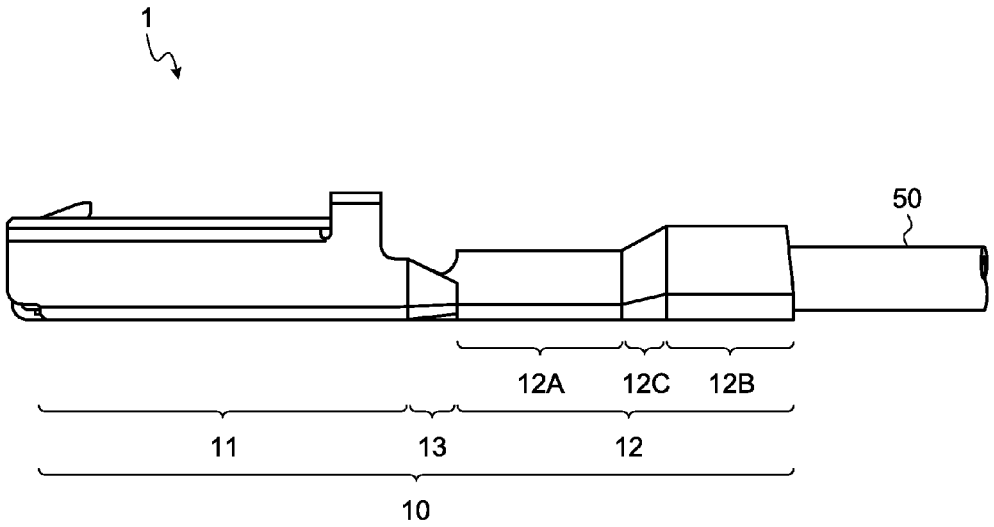
FIG. 4 is a side view illustrating the crimping terminal according to the embodiment after being crimped.

In a molding step, the crimping terminal 1 is molded into the shape of a flat plate, and from such a state, the terminal connection portion 11 is formed into the shape of a tube as illustrated in FIG. 1, in a terminal connection portion molding step. In the terminal connection portion molding step, the bending processing or the like is performed with respect to the terminal connection portion 11. The terminal connection portion 11 of this embodiment is formed such that a sectional surface is in the shape of a rectangular tube. The electric wire connection portion 12 is molded such that the sectional surface is in the shape of U, in the electric wire connection portion molding step. In the electric wire connection portion molding step, the bending processing or the like is performed with respect to the electric wire connection portion 12. In addition, in a sticking step, the water stop member 20 is stuck to the electric wire connection portion 12. The sticking step may be executed before the electric wire connection portion molding step, or may be executed after the electric wire connection portion molding step.

Figure 6:
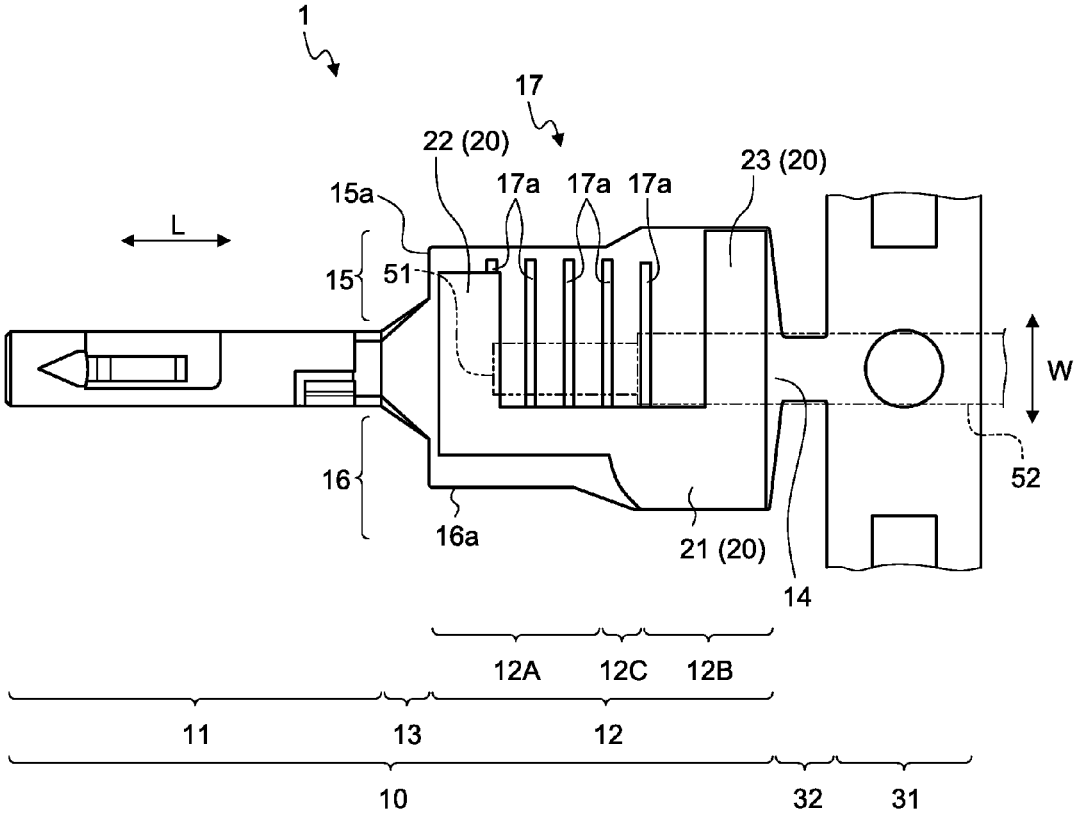
FIG. 6 is a plan view illustrating a state in which a water stop member is stuck to the crimping terminal according to the embodiment.

As illustrated in FIG. 1 and FIG. 6, the electric wire connection portion 12 includes a bottom portion 14, a first barrel piece portion 15, and a second barrel piece portion 16. The bottom portion 14 is a portion which is a bottom wall of the electric wire connection portion 12 which is formed into the shape of U. The end portion of the electric wire 50 is mounted on the bottom portion 14 at the time of crimping processing. The first barrel piece portion 15 and the second barrel piece portion 16 are portions which are the side walls of the electric wire connection portion 12 which is formed into the shape of U. The first barrel piece portion 15 and the second barrel piece portion 16 are jointed to an end portion of the bottom portion 14 in the second direction W. The first barrel piece portion 15 and the second barrel piece portion 16 protrude towards a direction intersecting with the width direction from the bottom portion 14 of the end portion in the width direction. In the electric wire connection portion 12 formed into the shape of U, in a case where the end portion of the electric wire 50 is mounted on the bottom portion 14, the first barrel piece portion 15 and the second barrel piece portion 16 surround the electric wire 50 from both sides in the second direction W.

In the first barrel piece portion 15 and the second barrel piece portion 16, lengths from a base of on the bottom portion 14 side to end surfaces of tip ends 15*a* and 16*a* may be identical to each other, or one length may be longer than the other length. In the crimping terminal 1 of this embodiment, the length from the base of the first barrel piece portion 15 to the tip end 15*a* is longer than the length from the base of the second barrel piece portion 16 to the tip end 16*a*. The first barrel piece portion 15 and the second barrel piece portion 16, for example, are wound around the electric wire 50 while overlapping with each other. In this embodiment, the second barrel piece portion 16 overlaps with the outside of the first barrel piece portion 15. Furthermore, the first barrel piece portion 15 and the second barrel piece portion 16 may be subjected to swaging referred to as so-called B crimping. In the B crimping, each of the first barrel piece portion 15 and the second barrel piece portion 16 is swaged by being bent towards the bottom portion 14 side and by pressing the tip ends 15*a* and 16*a* towards the electric wire 50. In the crimping terminal 1 of this embodiment, the water stop member 20 described below is disposed, and thus, the swaging processing of the former is adopted.

The end portion of the electric wire 50 is inserted to an opening portion of the U-shape of the electric wire connection portion 12, that is, a space on the inside of the U-shape from a gap of the tip ends 15*a* and 16*a*. The electric wire connection portion 12 is formed such that the end portion of the electric wire 50 is easily inserted thereto. Specifically, in the electric wire connection portion 12, an interval between the first barrel piece portion 15 and the second barrel piece portion 16 in the second direction W is widened towards the end surfaces of the tip ends 15*a* and 16*a* from the bottom portion 14 side.

As illustrated in FIG. 2 to FIG. 6, in the first barrel piece portion 15 and the second barrel piece portion 16, a join crimping unit 12C is interposed between a core crimping unit 12A and a cover crimping unit 12B. Each of the first barrel piece portion 15 and the second barrel piece portion 16 is one piece portion in which the crimping units 12A, 12C, and 12B are continuous in this order along the first direction L.

The core crimping unit 12A is a portion which is crimped with respect to the core 51 of the tip end of the electric wire 50. The core crimping unit 12A is a portion closest to the joining portion 13 of each of the barrel piece portions 15 and 16. The cover crimping unit 12B is a portion which is crimped with respect to an end portion of the cover 52. The cover crimping unit 12B is a portion which is positioned on a side farthest from the joining portion 13 side of each of the barrel piece portions 15 and 16. The join crimping unit 12C is a portion which joins the core crimping unit 12A and the cover crimping unit 12B together. The join crimping unit 12C is crimped with respect to a boundary portion between the core 51 and the cover 52 of the electric wire 50. The electric wire connection portion 12 integrally covers the core 51 and the cover 52 by being crimped with respect to the electric wire 50.

Figure 5:
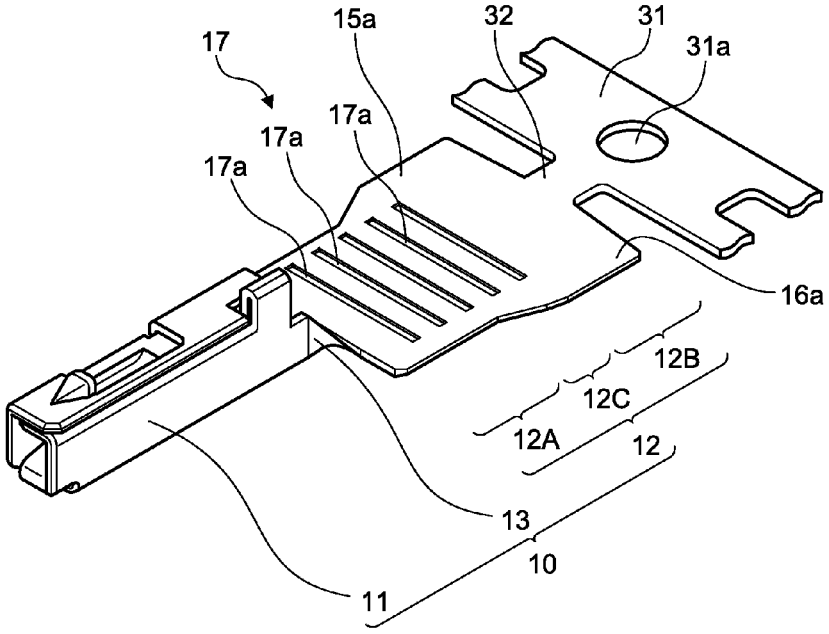
FIG. 5 is a perspective view illustrating a state before bending processing of an electric wire connection portion is performed in the crimping terminal according to the embodiment.

As illustrated in FIG. 5 and FIG. 6, a serration region 17 is disposed on an inner wall surface of the electric wire connection portion 12, that is, a wall surface on a side covering the electric wire 50. The serration region 17 is a core retention region retaining the core 51. The serration region 17 is a region including a portion wound around the core 51, on the inner wall surface of the electric wire connection portion 12. A plurality of recess portions, a plurality of projection portions, or a combination of the recess portion and the projection portion is disposed in the serration region 17. The recess portion or the projection portion increases a contact area between the electric wire connection portion 12 and the core 51, and thus, increase an adhesion strength between the electric wire connection portion 12 and the core 51. The serration region 17 of this embodiment is a rectangular region, and a plurality of recess portions 17*a* are formed in a position different from each other in the first direction L.

Here, it is not preferable that ingress of water occurs between the core 51, and the electric wire connection portion 12 crimped with respect to the core 51. For example, in a case where there is a difference in ionization tendency magnitudes between a metal material of the core 51 and a metal material of the electric wire connection portion 12, there is a possibility of corrosion. As an example, in a case where the material of the core 51 is aluminum, and the material of the electric wire connection portion 12 is copper, there is a possibility that the corrosion of the core 51 occurs. The water stop member 20 is disposed in the crimping terminal 1 of this embodiment. The water stop member 20 suppresses the ingress of water between the electric wire connection portion 12 and the core 51.

The water stop member 20, for example, is a member formed into the shape of a sheet, which is mainly consisted of an adhesive agent such as an acrylic adhesive agent. An adhesive sheet formed by infiltrating the adhesive agent into a sheet-like unwoven fabric, which has an adhesive effect on both surfaces, is used as the water stop member 20 of this embodiment.

The water stop member 20, for example, is stuck to the inner wall surface of the electric wire connection portion 12 in the shape of a flat plate, illustrated in FIG. 5. As illustrated in FIG. 6, the water stop member 20 is formed into a predetermined shape, and includes a first water stop portion 21, a second water stop portion 22, and a third water stop portion 23. The first water stop portion 21 performs water stop with respect to a portion where the first barrel piece portion 15 overlaps with the second barrel piece portion 16 after the crimping is completed. That is, the first water stop portion 21 is interposed between the first barrel piece portion 15 and the second barrel piece portion 16, which are overlapped with each other, and thus, a water stop region is formed between the barrel piece portions 15 and 16. The first water stop portion 21 of this embodiment is disposed in the second barrel piece portion 16, and extends along the first direction L.

The second water stop portion 22 performs water stop with respect to the core 51 on the terminal connection portion 11 side from the tip end. The second water stop portion 22 is disposed in the end portion of the electric wire connection portion 12 on the terminal connection portion 11 side, and extends along the second direction W. It is desirable that at least a part of the second water stop portion 22 is disposed in a region where the core 51 is mounted. The second water stop portion 22, for example, is interposed between the barrel piece portions 15 and 16 which are overlap with each other, and thus, a water stop region is formed in a gap between the barrel piece portions 15 and 16. The second water stop portions 22 overlap with each other in a crimping step, and thus, it is possible to block a gap of the core 51 on the terminal connection portion 11 side from the tip end. The second water stop portion 22 suppresses the ingress of water between the electric wire connection portion 12 and the core 51 from the terminal connection portion 11 side.

The third water stop portion 23 suppresses the ingress of water from the gap between the electric wire connection portion 12 and the cover 52. The third water stop portion 23 is disposed in the end portion of the electric wire connection portion 12 on a side opposite to the terminal connection portion 11 side, and extends along the second direction W. The third water stop portion 23 is interposed between the cover 52 and the electric wire connection portion 12, and thus, a water stop region is formed between the cover 52 and the electric wire connection portion 12.

The terminal clasp 10 described above is processed into the shape including the flat plate-like electric wire connection portion 12 illustrated in FIG. 5 through a pressing step with respect to one metal plate, which is a base material. After that, in the sticking step, the water stop member 20 is stuck to the flat plate-like electric wire connection portion 12. After that, in the terminal clasp 10, the terminal connection portion 11 is formed and the U-shaped electric wire connection portion 12 is formed in a bending step.

Figure 7:
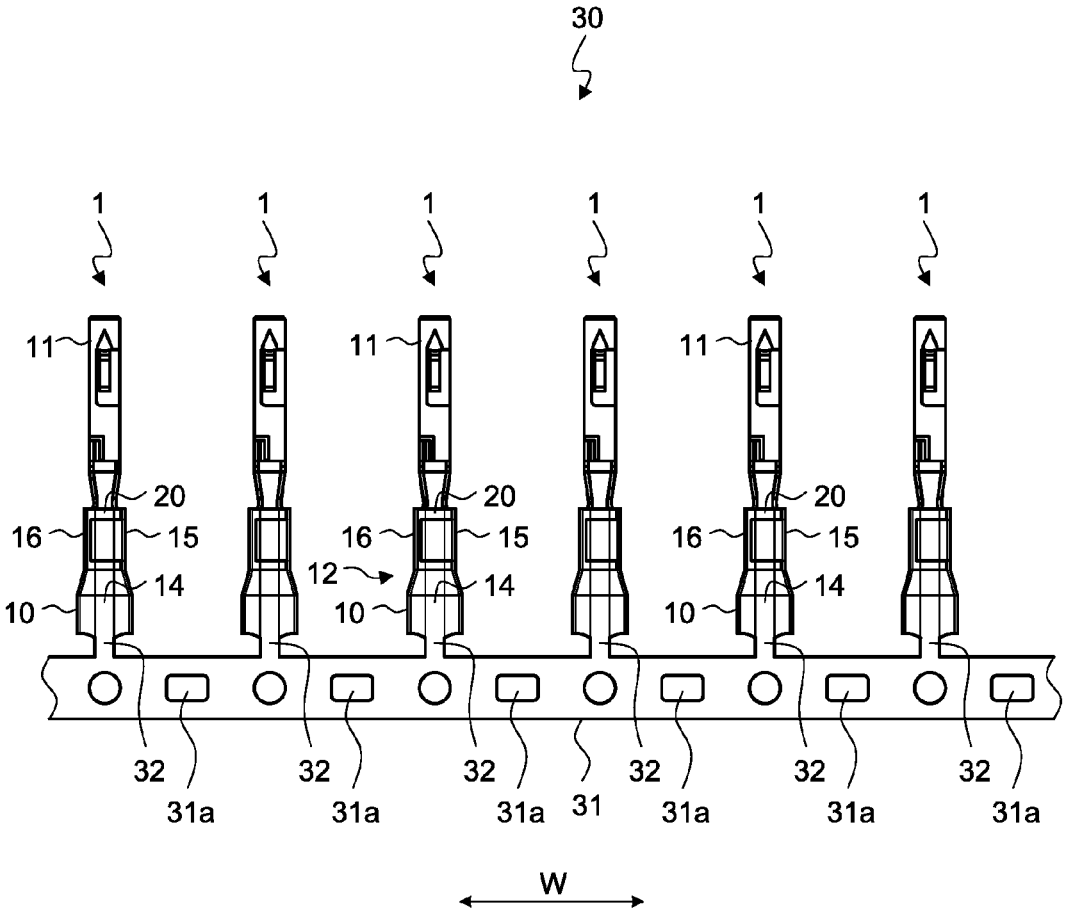
FIG. 7 is a plan view illustrating a terminal chain body of the embodiment.

In this embodiment, the terminal chain body 30 illustrated in FIG. 7 is formed by the pressing step or the bending step. The terminal chain body 30 includes a plurality of crimping terminals 1 which are chained to each other, and is formed of one metal plate. The terminal chain body 30 is supplied to a terminal crimping apparatus 100. The terminal crimping apparatus 100 executes the crimping step and a terminal cutting step with respect to the terminal chain body 30. The crimping step is a step in which the crimping terminal 1 of the terminal chain body 30 is swaged and crimped with respect to the electric wire 50. The terminal cutting step is a step in which the crimping terminal 1 swaged with respect to the electric wire 50 is separated from the terminal chain body 30.

The terminal chain body 30 is an aggregation of the crimping terminals 1. The terminal chain body 30 includes a joining piece 31, the plurality of crimping terminals 1, and a plurality of joints 32. The joining piece 31, the crimping terminal 1, and the joint 32 are formed of the same base material, and are integrated with each other. In the terminal chain body 30, each of the crimping terminals 1 is directed towards the same direction, and is arranged in parallel at regular intervals. In the terminal chain body 30, one end portions of each of the crimping terminals 1 are joined to each other by the joining piece 31. The joining piece 31, for example, is in the shape of an elongated rectangular plate. The joining piece 31 extends along the second direction W. The electric wire connection portion 12 is joined to the joining piece 31 through the joint 32. More specifically, the joint 32 joins the end portion of the bottom portion 14 on a side opposite to the terminal connection portion 11 side to the joining piece 31.

A plurality of terminal feeding holes 31*a* are formed in the joining piece 31. The terminal feeding holes 31*a* are arranged at regular intervals along a feeding direction of the terminal chain body 30. The terminal feeding hole 31*a* is a through hole penetrating into the joining piece 31 in a plate thickness direction. The positioning of the crimping terminal 1 is performed with respect to a crimping device 102 described below by the terminal feeding hole 31*a*. The terminal chain body 30 is set with respect to the terminal crimping device 100 in a state of being wound into the shape of a reel.

Figure 8:
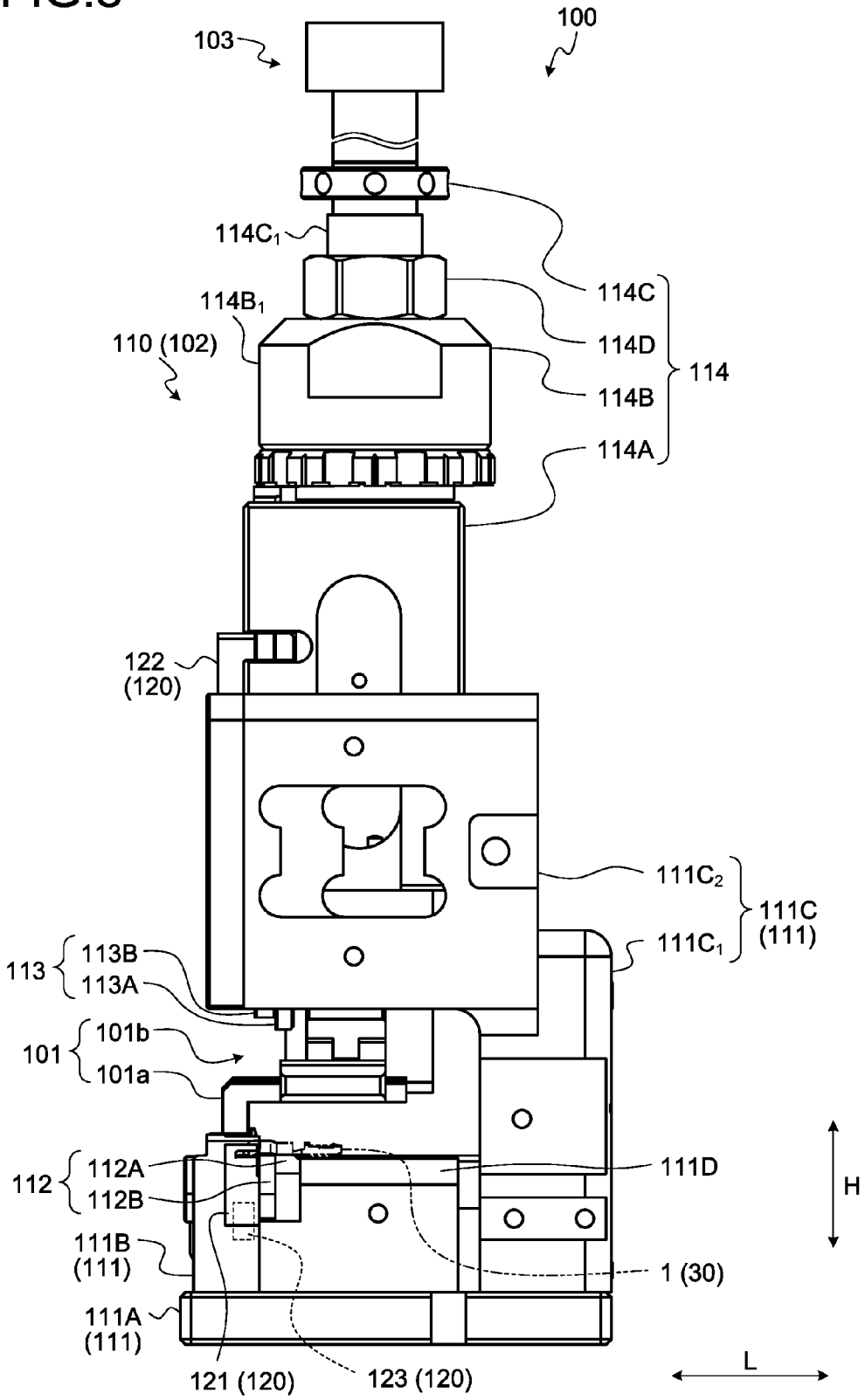
FIG. 8 is a side view of a terminal crimping apparatus according to the embodiment.
Figure 9:
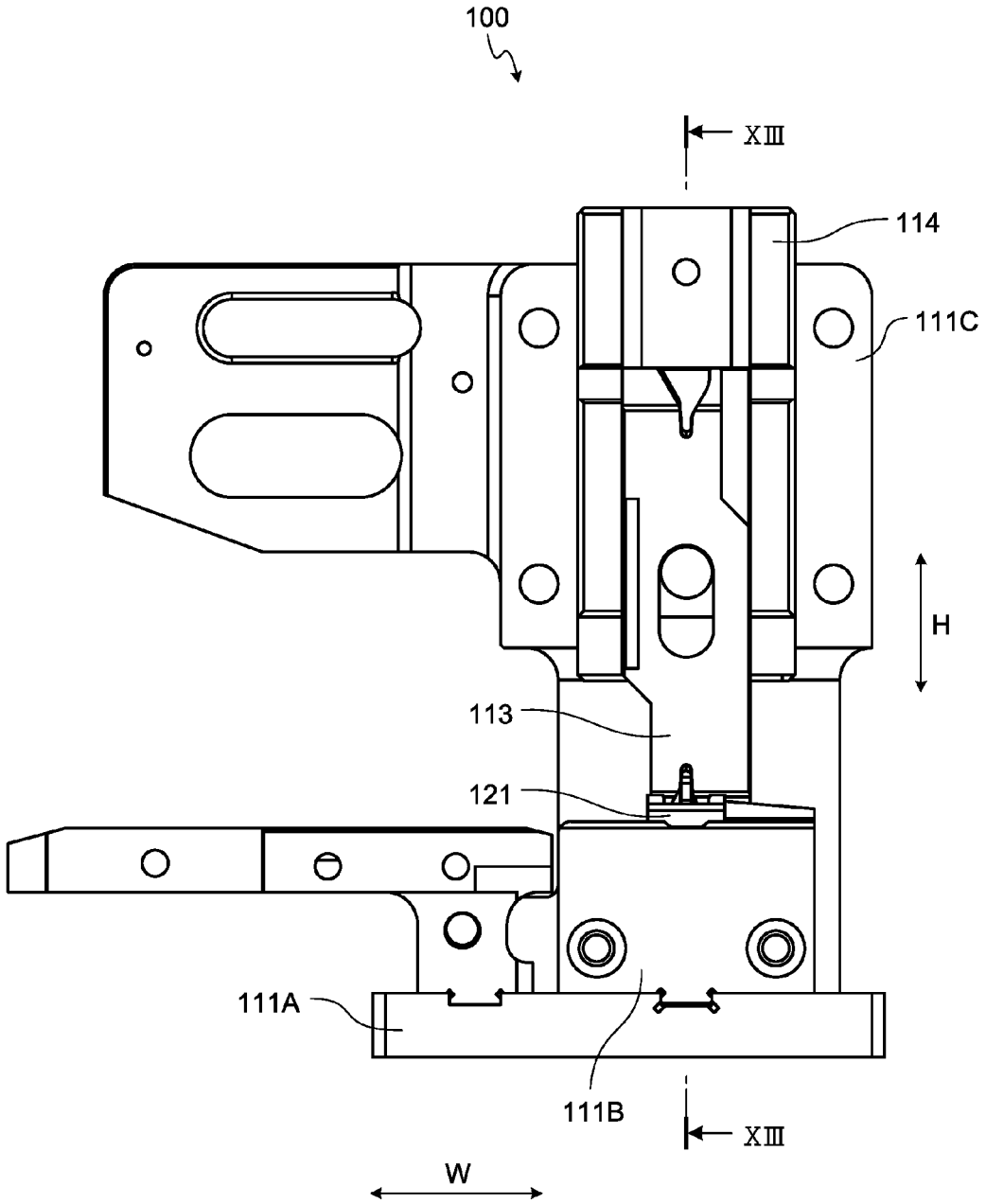
FIG. 9 is a front view of the terminal crimping apparatus according to the embodiment.

As illustrated in FIG. 8, the terminal crimping device 100 includes a terminal supply device 101, the crimping device 102, and a driving device 103. The terminal crimping apparatus 100 is a apparatus which is referred to as an applicator in the technical field. The terminal supply device 101 is a device which supplies the crimping terminal 1 to a predetermined crimping position. The crimping device 102 is a device which crimps the crimping terminal 1 with respect to the electric wire 50 in the predetermined crimping position. The driving device 103 is a device which operates the terminal supply device 101 and the crimping device 102.

The terminal supply device 101 sequentially takes out the terminal chain body 30 which is wound into the shape of a reel form from an outer circumference side. The terminal supply device 101 sequentially supplies the crimping terminal 1 of the taken terminal chain body 30 to a crimping position from a head side. In a case where crimping terminal 1 on the head is crimped with respect to the electric wire 50, and is separated from the joining piece 31, the terminal supply device 101 supplies the crimping terminal 1 which is newly becomes a head, to the crimping position. The terminal supply device 101 performs a supply operation whenever the crimping step and the terminal cutting step of one crimping terminal 1 are completed, and supplies the next crimping terminal 1 to the crimping position.

The terminal supply device 101 includes a terminal feeding member 101*a* and a power transmitting mechanism 101*b*. The terminal feeding member 101*a* includes a protruding portion which is inserted into the terminal feeding hole 31*a* of the joining piece 31. The terminal feeding member 101*a* moves the terminal chain body 30 in the feeding direction in a state where the protruding portion is inserted into the terminal feeding hole 31*a*. The power transmitting mechanism 101*b* operates the terminal feeding member 101*a* along with a crimping operation of the crimping device 102 (an up-and-down motion of a ram 114A or the like described below). The terminal supply device 101 moves the terminal feeding member 101*a* in an up-and-down direction and the feeding direction along with the crimping operation of the crimping device 102, and thus, supplies the crimping terminal 1 to the crimping position.

The crimping device 102 executes the crimping step of crimping the supplied crimping terminal 1 with respect to the electric wire 50, and the terminal cutting step of separating the crimping terminal 1 from the joining piece 31. The crimping device 102 includes a crimper 110 and a terminal cutting mechanism 120.

The crimper 110 is a device which swages the crimping terminal 1 in the end portion of the electric wire 50, and thus, crimps the crimping terminal 1 with respect to the electric wire 50. The crimper 110 of this embodiment swages the first barrel piece portion 15 and the second barrel piece portion 16 of the crimping terminal 1 to be wound around the core 51 and the cover 52 of the electric wire 50, and thus, crimps the crimping terminal 1 with respect to the electric wire 50. The crimper 110 includes a frame 111, a first metal mold 112, a second metal mold 113, and a power transmitting mechanism 114.

The frame 111 includes a pedestal 111A, an anvil support body 111B, a transmitting unit support body 111C, and a support base 111D. The pedestal 111A is a member forming the base of the terminal crimping apparatus 100. The pedestal 111A is fixed to a mounting base on which the terminal crimping apparatus 100 is mounted. The anvil support body 111B, the transmitting unit support body 111C, and the support base 111D are fixed onto the pedestal 111A.

The transmitting unit support body 111C is disposed on a rear side (a right side on the paper in FIG. 8) or an upper side (an upper side on the paper in FIG. 8) with respect to the anvil support body 111B. More specifically, the transmitting unit support body 111C includes an erected portion 111$C_1$ and a ram support portion 111$C_2$. The erected portion 111$C_1$ is disposed on a rear side of the anvil support body 111B, and is erected towards the upper side from the pedestal 111A. The ram support portion 111$C_2$ is retained in an upper portion of the erected portion 111$C_1$. The ram support portion 111$C_2$ is a support portion which supports the ram 114A described below. The ram support portion 111$C_2$ is disposed on an upper side of the anvil support body 111B at predetermined intervals with respect to the anvil support body 111B. The support base 111D is a base which supports the terminal connection portion 11 of the crimping terminal 1. A height position of an upper surface of the support base 111D is a position which is approximately identical to a height position of an upper surface of the first metal mold 112.

Figure 10:
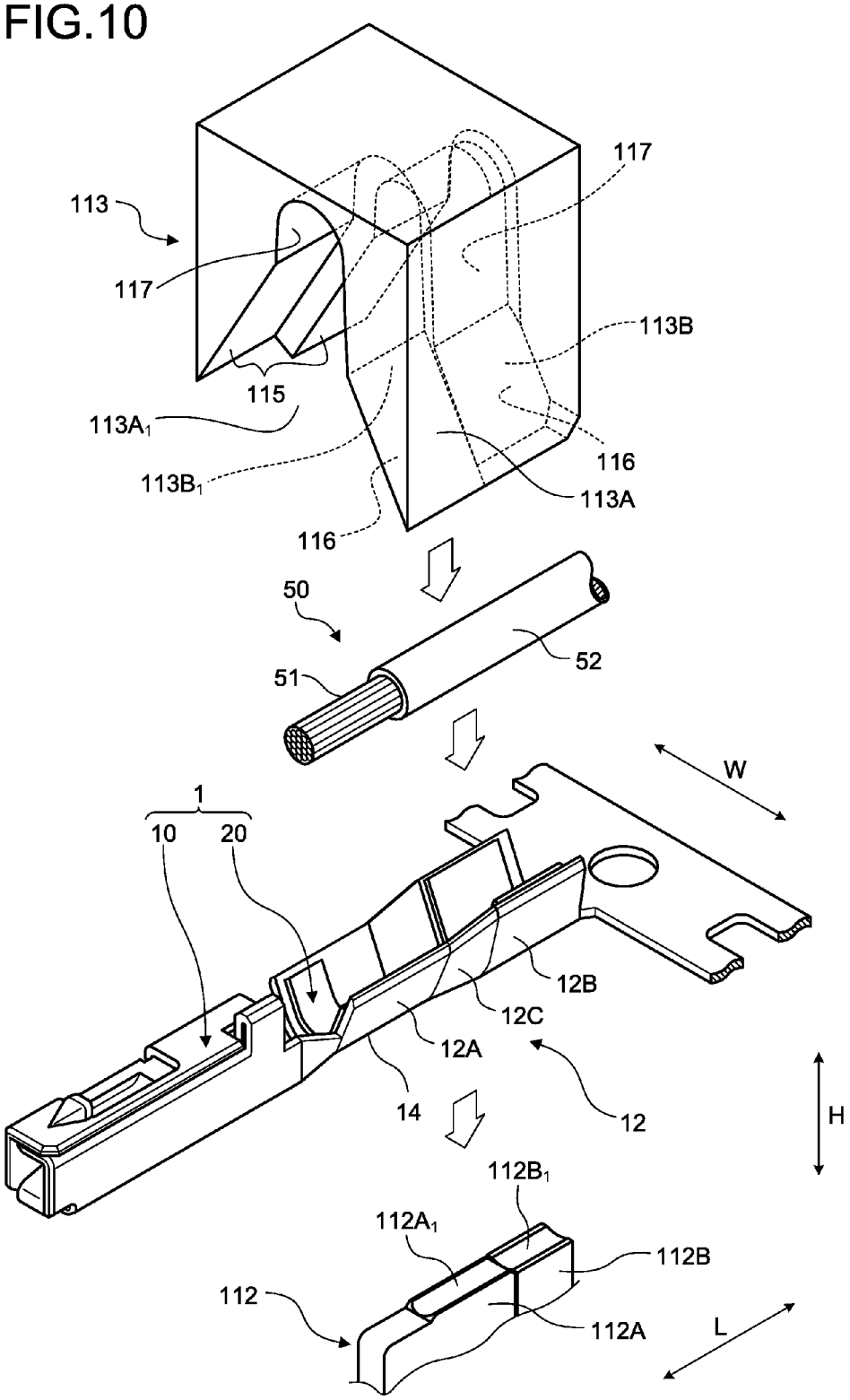
FIG. 10 is a perspective view illustrating a first metal mold and a second metal mold according to the embodiment.

The first metal mold 112 and the second metal mold 113 form a pair. The first metal mold 112 and the second metal mold 113 are arranged at an interval in the up-and-down direction. As illustrated in FIG. 10, the first metal mold 112 and the second metal mold 113 interpose the crimping terminal 1 and the electric wire 50 therebetween, and thus, crimps the crimping terminal 1 with respect to the electric wire 50. The first metal mold 112 is a metal mold which supports the crimping terminal 1 from a lower side. The first metal mold 112 is formed of two lower molds, and includes a first anvil 112A as a first lower mold and a second anvil 112B as a second lower mold. The first anvil 112A and the second anvil 112B, for example, are integrally molded. The second metal mold 113 is disposed on an upper side with respect to the first metal mold 112. The second metal mold 113 is formed of two upper molds, and includes a first crimper 113A as a first upper mold and a second crimper 113B as a second upper mold.

The first anvil 112A and the first crimper 113A face each other in the up-and-down direction. The first anvil 112A and the first crimper 113A crimp the core crimping unit 12A. That is, the first anvil 112A and the first crimper 113A have an interval therebetween, and thus, crimp the U-shaped core crimping unit 12A with respect to the core 51 by winding the U-shaped core crimping unit 12A around the core 51 of the electric wire 50.

The second anvil 112B and the second crimper 113B face each other in the up-and-down direction. The second anvil 112B and the second crimper 113B crimp the cover crimping unit 12B. That is, the second anvil 112B and the second crimper 113B have an interval therebetween, and thus, crimp the U-shaped cover crimping unit 12B with respect to the cover 52 by winding the U-shaped cover crimping unit 12B around the cover 52.

The driving device 103 transmits the power to the power transmitting mechanism 114, and thus, in the crimping step, the electric wire connection portion 12 is crimped with respect to the electric wire 50 at the interval between the first metal mold 112 and the second metal mold 113. On the other hand, in a case where the crimping step is completed, the driving device 103 widens the interval between the first metal mold 112 and the second metal mold 113. In the crimping device 102 of this embodiment, the second metal mold 113 is moved up and down with respect to the first metal mold 112, and thus, the interval between a pair of metal molds 112 and 113 is changed.

Furthermore, in the first metal mold 112, the first anvil 112A and the second anvil 112B may be separated from each other, and in the second metal mold 113, the first crimper 113A and the second crimper 113B may be separated from each other. In this case, the driving device 103 and the power transmitting mechanism 114 may be configured to be moved up and down separated from the first crimper 113A and the second crimper 113B.

The power transmitting mechanism 114 transmits the power output from the driving device 103 to the first crimper 113A and the second crimper 113B. As illustrated in FIG. 8, the power transmitting mechanism 114 includes the ram 114A, a ram bolt 114B, and a shank 114C.

The ram 114A is a movable member which is supported to be movable up and down with respect to the ram support portion 111$C_2$. The second metal mold 113 is fixed to the ram 114A. For this reason, the first crimper 113A and the second crimper 113B are moved up and down with respect to the ram support portion 111$C_2$ by being integrated with the ram 114A. The ram 114A, for example, is in the shape of a cube. A female screw portion (not illustrated) is formed in the ram 114A. The female screw portion is formed on an inner circumferential surface of a hole in the up-and-down direction, which is formed towards upper end surface from the inside of the ram 114A.

The ram bolt 114B includes a male screw portion (not illustrated), and the male screw portion is screwed to the female screw portion of the ram 114A. For this reason, the ram bolt 114B is moved up and down with respect to the ram support portion 111$C_2$ by being integrated with the ram 114A. In addition, the ram bolt 114B includes a bolt head portion 114$B_1$ which is disposed on an upper side of the male screw portion. A female screw portion (not illustrated) is formed in the bolt head portion 114$B_1$. The female screw portion of the bolt head portion 114$B_1$ is formed on an inner circumferential surface of a hole in the up-and-down direction, which is formed towards an upper end surface from the inside of the bolt head portion 114$B_1$.

The shank 114C is a cylindrical hollow member, and includes a male screw portion 114$C_1$ and a connection portion (not illustrated) in each end portion. The male screw portion 114$C_1$ of the shank 114C is formed on a lower side of the hollow member, and is screwed to the female screw portion of the bolt head portion 114$B_1$ of the ram bolt 114B. Accordingly, the shank 114C is moved up and down with respect to the ram support portion 111$C_2$ by being integrated with the ram 114A or the ram bolt 114B. The connection portion of the shank 114C is connected to the driving device 103.

The driving device 103 includes a driving source (not illustrated), and a power conversion mechanism (not illustrated) which converts a driving force of the driving source to power in the up-and-down direction. The connection portion of the shank 114C is joined to an output axis of the power conversion mechanism. Accordingly, the first crimper 113A and the second crimper 113B are moved up and down with respect to the ram support portion 111$C_2$ by being integrated with the ram 114A, the ram bolt 114B, and the shank 114C, according to the output of the driving device 103 (the output of the power conversion mechanism). An electric actuator such as an electric motor, a hydraulic actuator such as a hydraulic cylinder, a pneumatic actuator such as an air cylinder, and the like can be applied as the driving source of the driving device 103.

A relative position of the first crimper 113A in the up-and-down direction with respect to the first anvil 112A, and a relative position of the second crimper 113B in the up-and-down direction with respect to the second anvil 112B can be changed by adjusting a screwing amount between the female screw portion of the bolt head portion 114$B_1$ and the male screw portion 114$C_1$ of the shank 114C. The nut 114D is screwed to the male screw portion 114$C_1$ of the shank 114C on an upper side of the ram bolt 114B. Accordingly, the nut 114D functions as a so-called lock nut along with the female screw portion of the bolt head portion 114$B_1$. The nut 114D is fasten to the ram bolt 114B side after the adjustment of the relative position is completed, and thus, is capable of fixing the first crimper 113A and the second crimper 113B to the relative position.

As illustrated in FIG. 10, concave surfaces 112$A_1$ and 112$B_1$, which are recessed towards a lower side, are formed in a tip end of each of the first anvil 112A and the second anvil 112B on an upper side. Each of the concave surfaces 112$A_1$ and 112$B_1$ is formed such that a sectional surface is in the shape of an arc according to the shape of the bottom portion 14 of each of the U-shaped core crimping unit 12A and the U-shaped cover crimping unit 12B. In the crimper 110, each of the concave surfaces 112$A_1$ and 112$B_1$ is the crimping position. The crimping terminal 1 which has been supplied by setting the bottom portion 14 to be on the lower side, the bottom portion 14 of the core crimping unit 12A is mounted on the concave surface 112$A_1$ of the first anvil 112A, and the bottom portion 14 of the cover crimping unit 12B is mounted on the concave surface 112$B_1$ of the second anvil 112B. The first metal mold 112 is supported by the anvil support body 111B in a state where the concave surfaces 112$A_1$ and 112$B_1$ are exposed to the upper side.

As illustrated in FIG. 10, concave portions 113$A_1$ and 113$B_1$, which are recessed towards the upper side, are formed in each of the first crimper 113A and the second crimper 113B. Each of the concave portions 113$A_1$ and 113$B_1$ is disposed to face each of the concave surfaces 112$A_1$ and 112$B_1$ of the first anvil 112A and the second anvil 112B in the up-and-down direction. Each of the concave portions 113$A_1$ and 113$B_1$ includes a first wall surface 115, a second wall surface 116, and a third wall surface 117. The first wall surface 115 and the second wall surface 116 face each other in the second direction W. The third wall surface 117 joins upper ends of the first and second wall surfaces 115 and 116. Each of the concave portions 113$A_1$ and 113$B_1$ swages the first barrel piece portion 15 and the second barrel piece portion 16 by winding the first barrel piece portion 15 and the second barrel piece portion 16 around the end portion of the electric wire 50 while allowing the first to third wall surfaces 115, 116, and 117 to be brought into contact with the first barrel piece portion 15 and the second barrel piece portion 16. Each of the concave portions 113$A_1$ and 113$B_1$ is formed to perform such a swaging operation.

The crimping terminal 1, which is subjected to the crimping processing by the crimper 110, is separated from the joining piece 31 by the terminal cutting mechanism 120. The terminal cutting mechanism 120 cuts the joint 32 of the crimping terminal 1 supplied to the crimping position by interposing the joint 32 between two terminal cutting portions, and performs the separation along with the proceeding of the crimping step. As illustrated in FIG. 8, the terminal cutting mechanism 120 is disposed on a front side (a left side on the paper in FIG. 8) from the second anvil 112B. The terminal cutting mechanism 120 includes a terminal cutting body 121, a push down member 122, and an elastic member 123.

Figure 11:
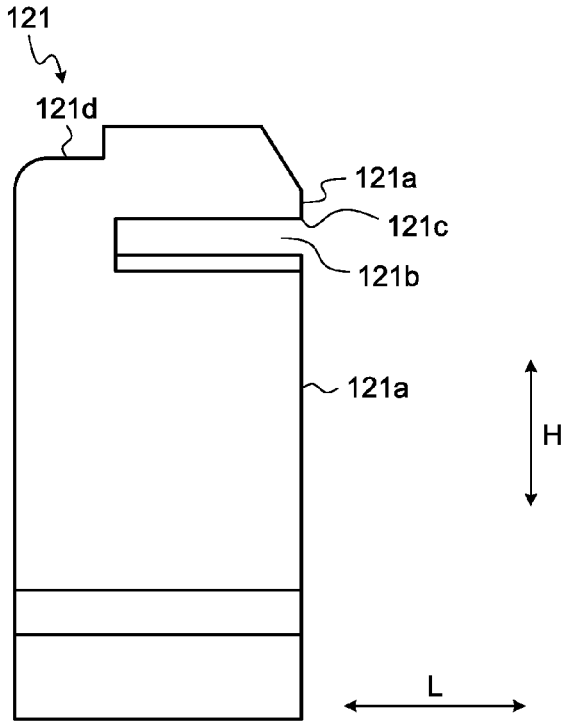
FIG. 11 is a side view illustrating a terminal cutting body according to the embodiment.

The terminal cutting body 121 is molded into the shape of a cube, and is disposed to slide in the up-and-down direction along the front surface of the second anvil 112B. As illustrated in FIG. 11 and FIG. 12, a slit 121*b* is formed in the terminal cutting body 121 towards the inside from a sliding contact surface 121*a* with respect to the second anvil 112B. The slit 121*b* is a passage of the joining piece 31 of the terminal chain body 30. When the crimping terminal 1, which is the crimping target, is supplied to the crimping position, a part of the joint 32 joined to the crimping terminal 1 protrudes from the slit 121*b*. The crimping terminal 1 supplied to the crimping position is supported from the lower side by the first metal mold 112.

The terminal cutting body 121 cuts the joint 32 while being relatively moved up and down with respect to the first metal mold 112 and the crimping terminal 1. Here, a position, in which the joining piece 31 or the like can be inserted into the slit 121*b*, is an initial position of the terminal cutting body 121 in the up-and-down direction. As illustrated in FIG. 13, an end portion of the joint 32 on the electric wire connection portion 12 side protrudes from the slit 121*b* through an opening of the slit 121*b* on the sliding contact surface 121*a* side (that is, the crimping terminal 1 side). In the terminal cutting body 121, an edge portion (hereinafter, referred to as an "opening edge") 121*c* of the opening on the upper side is used as one terminal cutting portion. The other terminal cutting portion is an upper surface edge 112*a* of the second anvil 112B.

The push down member 122 is fixed to the ram 114A, and is moved up and down by being integrated with the ram 114A. The push down member 122 is disposed on the upper side of the terminal cutting body 121, and is lowered, and thus, the terminal cutting body 121 is pushed down. The push down member 122 is molded into the shape of a cube. The elastic member 123 applies a biasing force to the terminal cutting body 121 on the upper side, and is formed of a spring member or the like. When a pushing down force from the push down member 122 is released, the elastic member 123 returns the terminal cutting body 121 to the initial position in the up-and-down direction.

In the terminal cutting mechanism 120, the push down member 122 is lowered along with the lowering of the second metal mold 113 at the time of the crimping processing, and the terminal cutting body 121 is pushed down. The terminal cutting body 121 is lowered, and thus, the joint 32 is interposed between the opening edge 121*c* of the slit 121*b* and the upper surface edge 112*a* of the second anvil 112B (FIG. 13). In the terminal cutting mechanism 120, the opening edge 121*c* and the upper surface edge 112*a* function as scissors, and apply a shearing force to the joint 32. The terminal cutting body 121 is further pushed down, and thus, the opening edge 121*c* and the upper surface edge 112*a* cut the joint 32, and separate the crimping terminal 1 from the joining piece 31. Furthermore, in order to increase cutting properties, the opening edge 121*c* is inclined with respect to the upper surface edge 112*a* on the sliding contact surface 121*a*.

As illustrated in FIG. 13, the electric wire 50, which is the crimping target, is disposed on the predetermined position between the terminal cutting body 121 and the push down member 122. Specifically, the electric wire 50 is mounted on an upper surface 121*d* of the terminal cutting body 121. For this reason, a space for escaping the electric wire 50 is provided in at least one of the upper portion of the terminal cutting body 121 and the lower portion of the push down member 122 such that the electric wire 50 is not crushed between the upper portion of the terminal cutting body 121 and the lower portion of the push down member 122.

Here, the predetermined position is a position in which the end portion of the electric wire 50 before the crimping processing is on the upper side of the bottom portion 14 of the flat plate-like electric wire connection portion 12. In addition, the predetermined position is a position in which the core 51 can be mounted on the bottom portion 14 of the core crimping unit 12A such that the tip end of the core 51 which is pushed down along with the start of the crimping processing does not protrude from the core crimping unit 12A. The core 51 is stretched in an axis line direction along the crimping processing, and a tip end position of the core 51 is moved along the axis line direction. It is desirable that the predetermined position is determined in consideration of the stretching.

On the other hand, the end portion (the core 51 or the cover 52 on the tip end) of the electric wire 50 is pushed down to the electric wire connection portion 12 on the inner wall surface side by the second metal mold 113. For this reason, in a case where the electric wire 50 is not retained at all, there is a concern that the electric wire 50 floats from the upper surface 121*d* of the terminal cutting body 121, and the core 51 or the cover 52 on the tip end is crimped in a state of not being mounted in the bottom portion 14 of the electric wire connection portion 12. For this reason, the terminal crimping apparatus 100 of this embodiment includes an electric wire retention mechanism in which the electric wire 50 is retained in the predetermined position with respect to the upper portion of the terminal cutting body 121, and a positional shift of the end portion of the electric wire 50 with respect to the electric wire connection portion 12 during the crimping processing is suppressed.

The electric wire retention mechanism includes an electric wire presser 118 retaining the electric wire 50 mounted on the upper surface 121*d* of the terminal cutting body 121 as an electric wire mounting portion by pressing the electric wire 50 against the upper surface 121*d* (FIG. 13). The electric wire presser 118 is disposed on the upper side of the terminal cutting body 121 and between the second metal mold 113 and the push down member 122. A space (hereinafter, referred to as an "electric wire retention space") 118A retaining the cover 52 of the electric wire 50 is formed between the upper surface 121*d* of the terminal cutting body 121 and the lower surface of the electric wire presser 118. The electric wire retention space 118A suppresses the floating of the electric wire 50 from the upper surface 121*d* of the terminal cutting body 121 in the crimping step, and suppresses the positional shift of the core 51 or the cover 52 on the tip end with respect to the electric wire connection portion 12. The electric wire presser 118 can be moved up and down with respect to the upper surface 121*d* of the terminal cutting body 121, and is lowered, and thus, the electric wire retention space 118A is formed between the electric wire presser 118 and the upper portion of the terminal cutting body 121. The electric wire presser 118, for example, is fixed to the ram 114A, and is moved up and down by being integrated with the ram 114A. The electric wire 50 is retained in the electric wire retention space 118A which is formed along with the lowering of the electric wire presser 118.

According to the terminal crimping apparatus 100 configured as described above, when the core crimping unit 12A is crimped with respect to the core 51, the core crimping unit 12A is pressed against the core 51 at a high pressure. The core 51, the core crimping unit 12A, or the water stop member 20, to which a pressure force is applied, is stretched along the first direction L. In the crimping step, there is a possibility that the pressed core 51 is stretched and protrudes to the outside from the core crimping unit 12A, or the pressed water stop member 20 considerably protrudes to the outside from the core crimping unit 12A. As a result thereof, in the crimping terminal 1, there is a concern that a decrease in sealing properties or a decrease in electric performance occurs. In addition, in a case where the water stop member 20 excessively protrudes from the core crimping unit 12A, there is a case where the water stop member 20 is attached to the second metal mold 113. As a result thereof, a decrease in the sealing properties is caused, or the crimping terminal 1 is not smoothly taken out from the second metal mold 113.

As described below, the terminal crimping apparatus 100 of this embodiment has a configuration in which the protrusion of the core 51 or the water stop member 20 from the core crimping unit 12A can be suppressed. As illustrated in FIG. 15, in the second metal mold 113 of this embodiment, the concave portion 113$A_1$ includes a diameter expansion portion 113C. The diameter expansion portion 113C is disposed in an end portion of the concave portion 113$A_1$ on a side opposite to the second crimper 113B side. That is, the diameter expansion portion 113C is disposed in the end portion of the core 51, which is the crimping target, on the tip end side.

In the diameter expansion portion 113C, a sectional area of a space surrounded by the concave portion 113$A_1$ and the first metal mold 112 is large compared to a sectional area of the portion 113D on a base end side from the diameter expansion portion 113C. Furthermore, here, the "sectional area" is a sectional area of a sectional surface orthogonal to the first direction L. The portion 113D on the base end side is a portion of the concave portion 113$A_1$ on the second crimper 113B side from the diameter expansion portion 113C. In the diameter expansion portion 113C, the third wall surface 117 is widened towards an upper side, compared to the portion 113D on the base end side. More specifically, the third wall surface 117 of the first crimper 113A includes a step portion 117A in an end portion on a side separated from the second crimper 113B. The step portion 117A is positioned on a further upper side from the other portion of the third wall surface 117 of the first crimper 113A. A height position of the third wall surface 117 is changed towards the step portion 117A in the shape of a step. As illustrated in FIG. 14, the step portion 117A is in the shape of an arc seen in the plan view, as with the other portion of the third wall surface 117.

In the diameter expansion portion 113C, the sectional area of the space surrounded by the concave portion 113$A_1$ and the first metal mold 112 increases from the portion 113D on the base end side. Furthermore, a magnitude relationship of the sectional area is a magnitude relationship compared with a case where the position of the second metal mold 113 in the third direction H is the same. The diameter expansion portion 113C, for example, is formed such that the magnitude relationship described above is established when the second metal mold 113 is at least in the bottom dead center. The bottom dead center is a lower end position in a range where the second metal mold 113 is moved up and down. In a case where the second metal mold 113 is in the bottom dead center, the first metal mold 112 is closest to the second metal mold 113 in the third direction H.

According to the second metal mold 113 of this embodiment, when the core crimping unit 12A is crimped with respect to the core 51 of the electric wire 50, a pressure force of the diameter expansion portion 113C is smaller than a pressure force of the portion 113D on the base end side. In addition, a compression rate at which the diameter expansion portion 113C compresses the core 51 is less than a compression rate at which the portion 113D on the base end side compresses the core 51. Accordingly, the protrusion of the core 51 from the core crimping unit 12A or the excessive protrusion of the water stop member 20 is suppressed. The diameter expansion portion 113C of this embodiment is disposed in a range corresponding to the third water stop portion 23 in the first direction L. That is, in the concave portion 113$A_1$, the diameter expansion portion 113C is disposed in a position where the third water stop portion 23 is compressed. Accordingly, the excessive protrusion of the water stop member 20, for example, protrusion to the extent of being attached to the second metal mold 113 is preferably suppressed.

The diameter expansion portion 113C of this embodiment is configured by widening the third wall surface 117 towards the upper side. A height from the concave surface 112$A_1$ of the first metal mold 112 to the third wall surface 117 is low in the portion 113D on the base end side, and becomes relatively higher in the diameter expansion portion 113C. On the other hand, an interval between the first wall surface 115 and the second wall surface 116 in the second direction W is identical to an interval between the diameter expansion portion 113C and the portion 113D on the base end side. That is, the diameter expansion portion 113C is formed such that the flatness of the core crimping unit 12A and the core 51 after being crimped decreases, compared to the portion 113D on the base end side. The flatness of the crimped core crimping unit 12A decreases due to the diameter expansion portion 113C, and thus, it is difficult for the core 51 or the water stop member 20 to protrude to the outside from the core crimping unit 12A.

Figure 16:
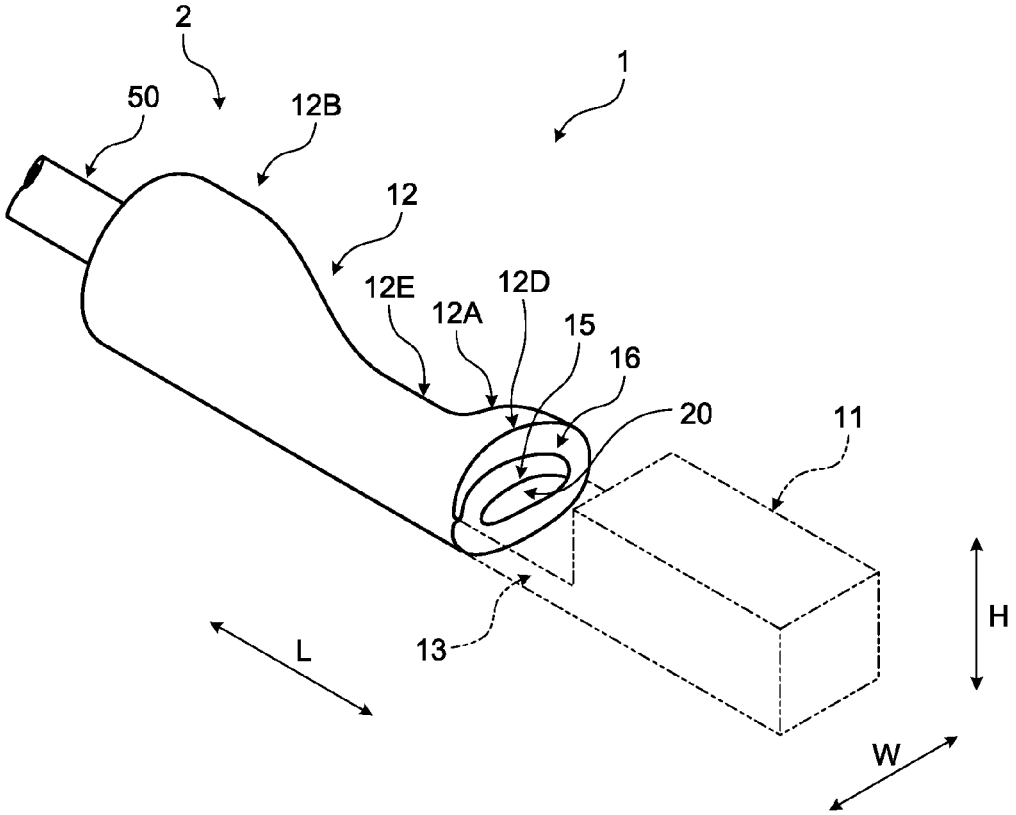
FIG. 16 is a perspective view illustrating the electric wire connection portion according to the embodiment after being crimped.

FIG. 16 illustrates the electric wire connection portion 12 which is crimped with respect to the electric wire 50 by the second metal mold 113 of this embodiment. FIG. 17 illustrates a vertical sectional surface of the crimped electric wire connection portion 12. FIG. 17 illustrates a sectional surface orthogonal to the second direction W, and a sectional surface along the center line of the electric wire 50. The electric wire connection portion 12, to which the water stop member 20 is stuck in advance, is crimped with respect to the electric wire 50, and thus, an electric wire 2 with a terminal is manufactured. The water stop members 20 adhere to each other by being compressed in the crimping step, and block the opening of the end portion of the core crimping unit 12A. In addition, the water stop member 20 covers the tip end portion of the core 51, and regulates the ingress of water with respect to an inner space of the core crimping unit 12A. Furthermore, in a case where a part of the water stop member 20 compressed between the electric wire 50 and the electric wire connection portion 12 is extruded to the terminal connection portion 11 side, the extruded water stop member 20 covers the tip end portion of the core 51, and thus, is capable of blocking the opening of the core crimping unit 12A.

As illustrated in FIG. 16, the core crimping unit 12A according to this embodiment after being crimped includes a diameter expansion portion 12D in an end portion on the terminal connection portion 11 side. A sectional area of the diameter expansion portion 12D (for example, an area surrounded by the outermost diameter of the diameter expansion portion 12D) is larger than a sectional area of a portion 12E of the core crimping unit 12A on the base end side (for example, an area surrounded by the outermost diameter of the portion 12E on the base end side). A difference between the sectional areas accords to a difference between the shape of the diameter expansion portion 113C of the second metal mold 113 and the shape of the portion 113D on the base end side. A main difference between the diameter expansion portion 12D and the portion 12E on the base end side is a height dimension, that is, a length in the third direction H. The height of the diameter expansion portion 12D is higher than the height of the portion 12E on the base end side. Furthermore, the width of the diameter expansion portion 12D is identical to the width of the portion 12E on the base end side.

Figure 20:
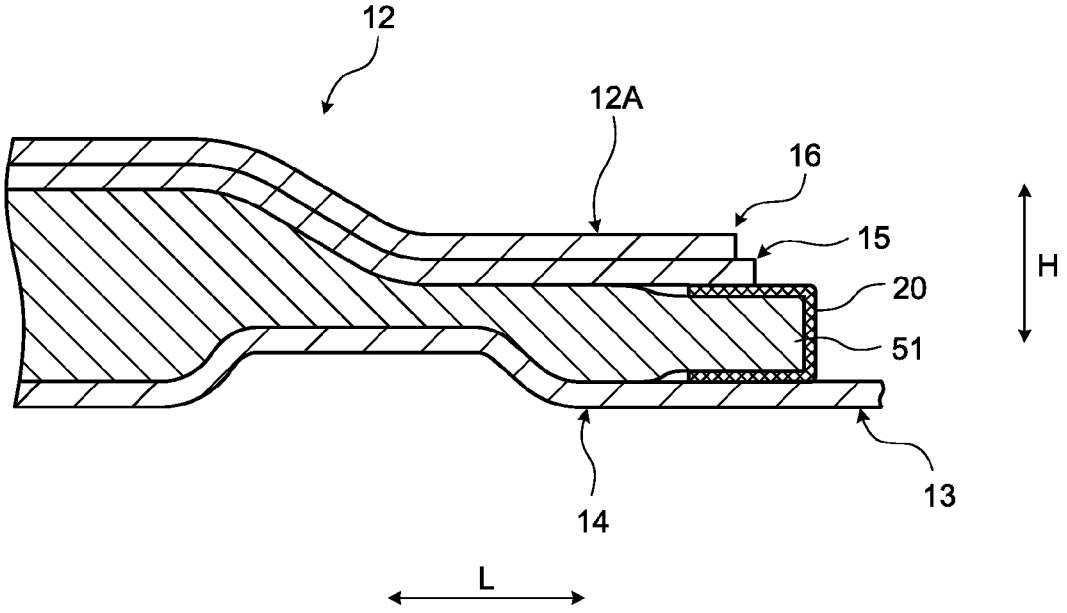
FIG. 20 is a vertical sectional view of an electric wire connection portion according to a comparative example after being crimped.

FIG. 20 illustrates a vertical sectional surface of a core crimping unit according to a comparative example. A second metal mold crimping a core crimping unit 12A of the comparative example is different from the second metal mold 113 of this embodiment, and the diameter expansion portion 113C is not provided. In the core crimping unit 12A of the comparative example, the water stop member 20 and the core 51 after being crimped considerably protrude to the outside from the core crimping unit 12A. This is because the tip end portion of the core crimping unit 12A is considerably compressed as with the other portion. The water stop member 20 considerably protrudes, and thus, water stop performance decreases, or the water stop member 20 is attached to the second metal mold 113. In contrast, in the core crimping unit 12A crimped by the second metal mold 113 of this embodiment, as illustrated in FIG. 17, the water stop member 20 and the core 51 considerably protrude to the outside from the core crimping unit 12A. The water stop member 20 slightly protrudes from the core crimping unit 12A, but does not protrude to the extent of being attached to the second metal mold 113. The water stop member 20 covers the tip end of the core 51, and seals a gap between the core 51 and the core crimping unit 12A. Accordingly, the terminal crimping apparatus 100 of this embodiment is capable of suppressing a decrease in the sealing properties or a decrease in the electric performance of the core crimping unit 12A. In addition, the terminal crimping apparatus 100 of this embodiment is capable of preventing the water stop member 20 from being attached to the second metal mold 113.

Figure 21:
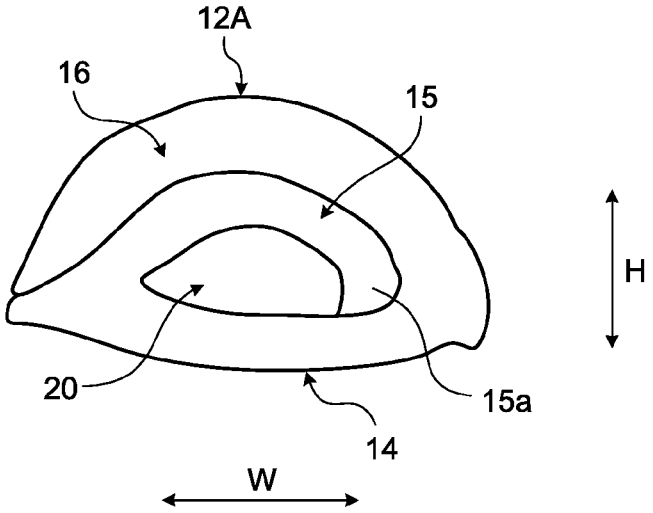
FIG. 21 is a diagram illustrating an end portion of the electric wire connection portion according to the comparative example after being crimped.

In addition, according to the second metal mold 113 of this embodiment, as described above, it is possible to improve the electric performance of the core crimping unit 12A. FIG. 21 illustrates the end portion of the core crimping unit 12A of the comparative example. FIG. 21 illustrates a diagram in which the end portion of the core crimping unit 12A of FIG. 20 is seen from the first direction L. In the core crimping unit 12A of the comparative example, the tip end 15*a* of the first barrel piece portion 15 is in contact of the inner surface of the second barrel piece portion 16 or the bottom portion 14. The tip end 15*a* of the first barrel piece portion 15 is in contact with the inner wall surface during the crimping, and thus, further deformation of the first barrel piece portion 15 is easily regulated. As a result thereof, it is difficult for the first barrel piece portion 15 and the second barrel piece portion 16 to suitably overlap with each other.

Figure 19:
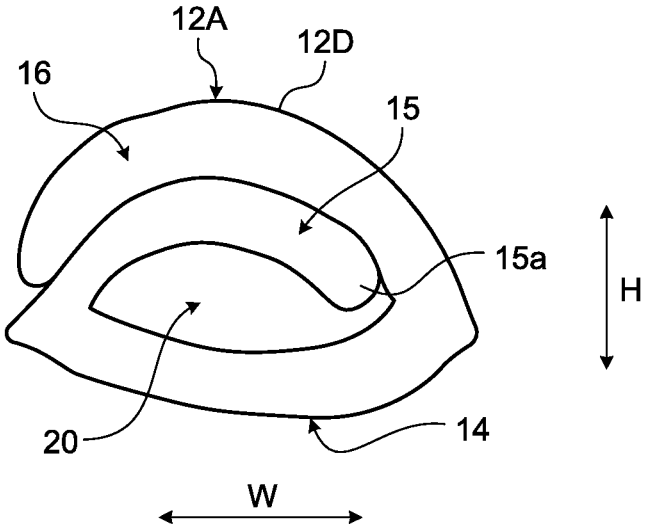
FIG. 19 is a diagram illustrating an end portion of the electric wire connection portion according to the embodiment after being crimped.

In contrast, in the core crimping unit 12A according to this embodiment, as illustrated in FIG. 19, the tip end 15*a* of the first barrel piece portion 15 is not in contact with the inner wall surface. After the crimping is completed, the tip end 15*a* of the first barrel piece portion 15 is separated from the bottom portion 14. The diameter expansion portion 113C is formed to crimp the tip end 15*a* of the first barrel piece portion 15 with respect to the core 51 without bringing the tip end 15*a* of the first barrel piece portion 15 into contact with the bottom portion 14. The first barrel piece portion 15 is not in contact with the bottom portion 14, and thus, it is difficult to regulate the deformation of the first barrel piece portion 15 during the crimping. When the first barrel piece portion 15 and the second barrel piece portion 16 overlap with each other while being inclined towards the inside, it is difficult to disturb the deformation of the barrel piece portions 15 and 16, and thus, a sufficient lapping amount or a sufficient lapping width is ensured. Accordingly, the terminal crimping apparatus 100 according to this embodiment is capable of improving the electric performance of the core crimping unit 12A after being crimped.

Figure 22:
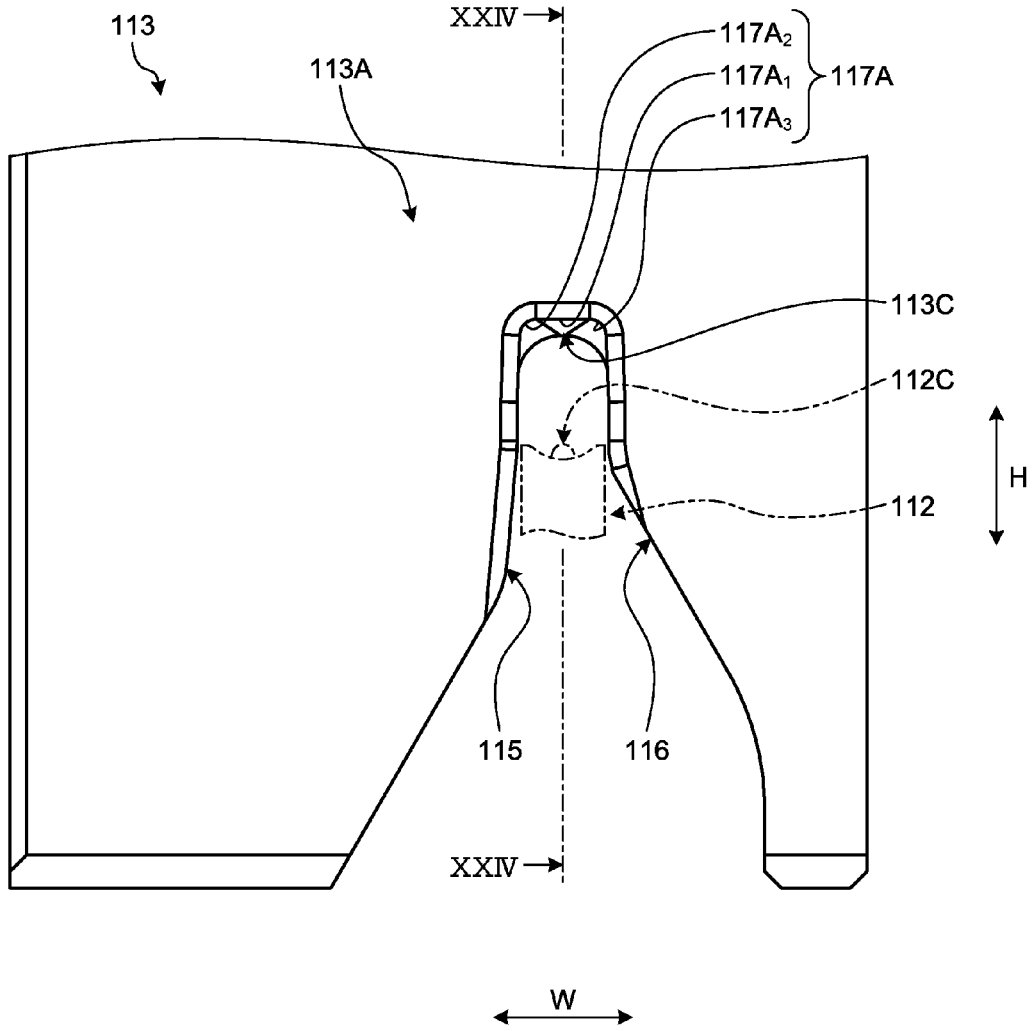
FIG. 22 is a front view of a second metal mold according to a second example of the embodiment.
Figure 23:
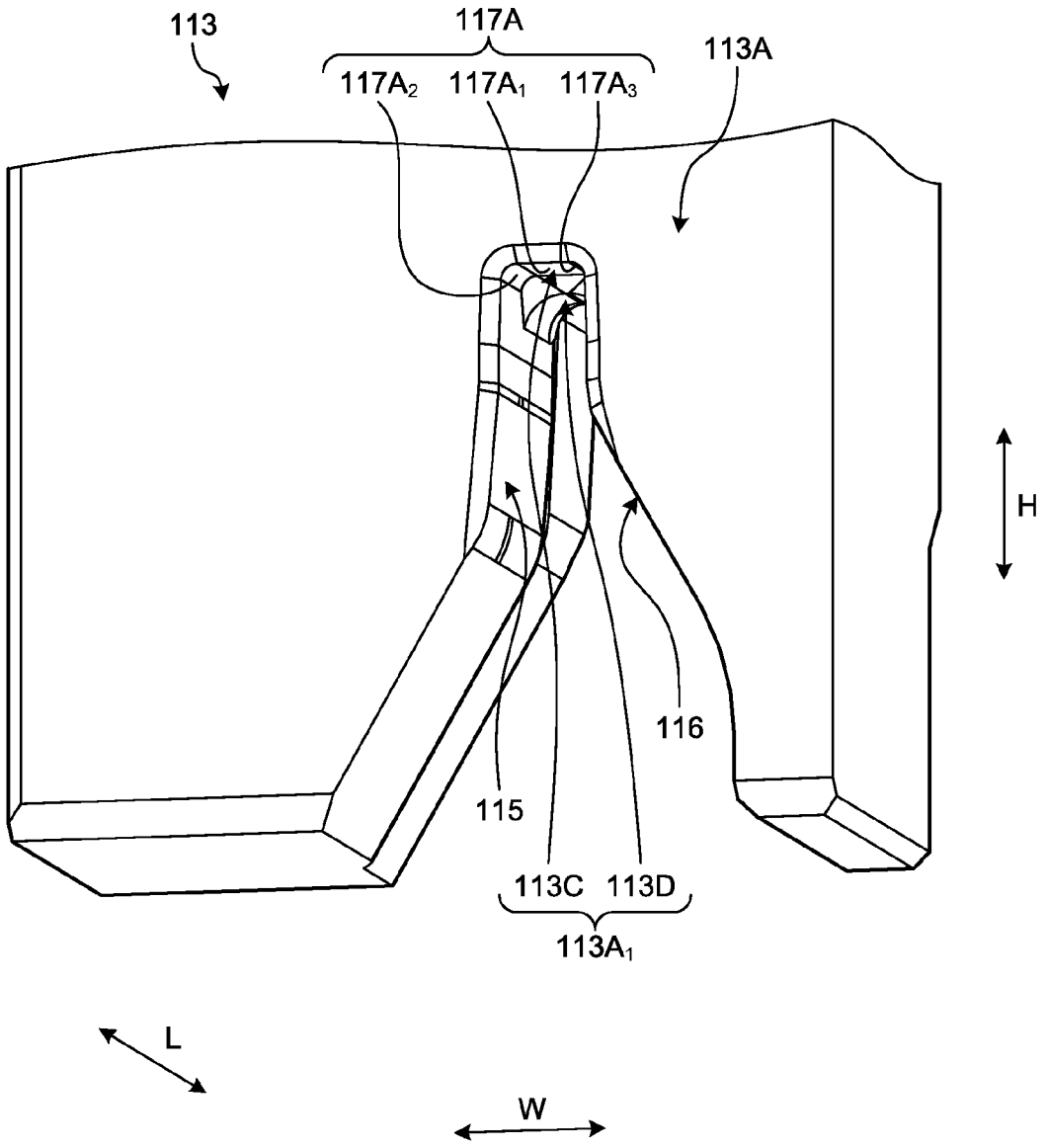
FIG. 23 is a perspective view of the second metal mold according to the second example of the embodiment.
Figure 24:
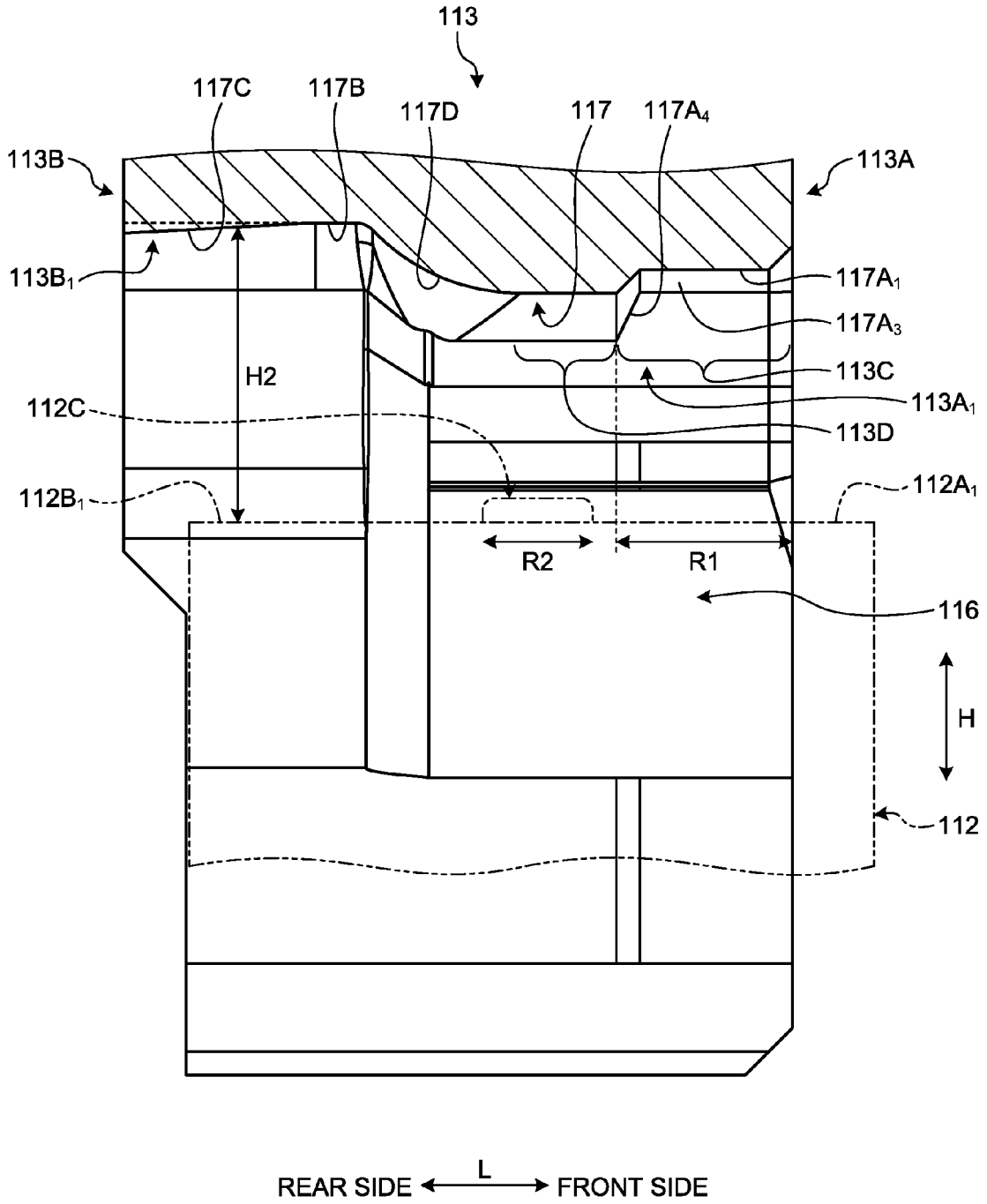
FIG. 24 is a sectional view of the second metal mold according to the second example of the embodiment.
Figure 25:
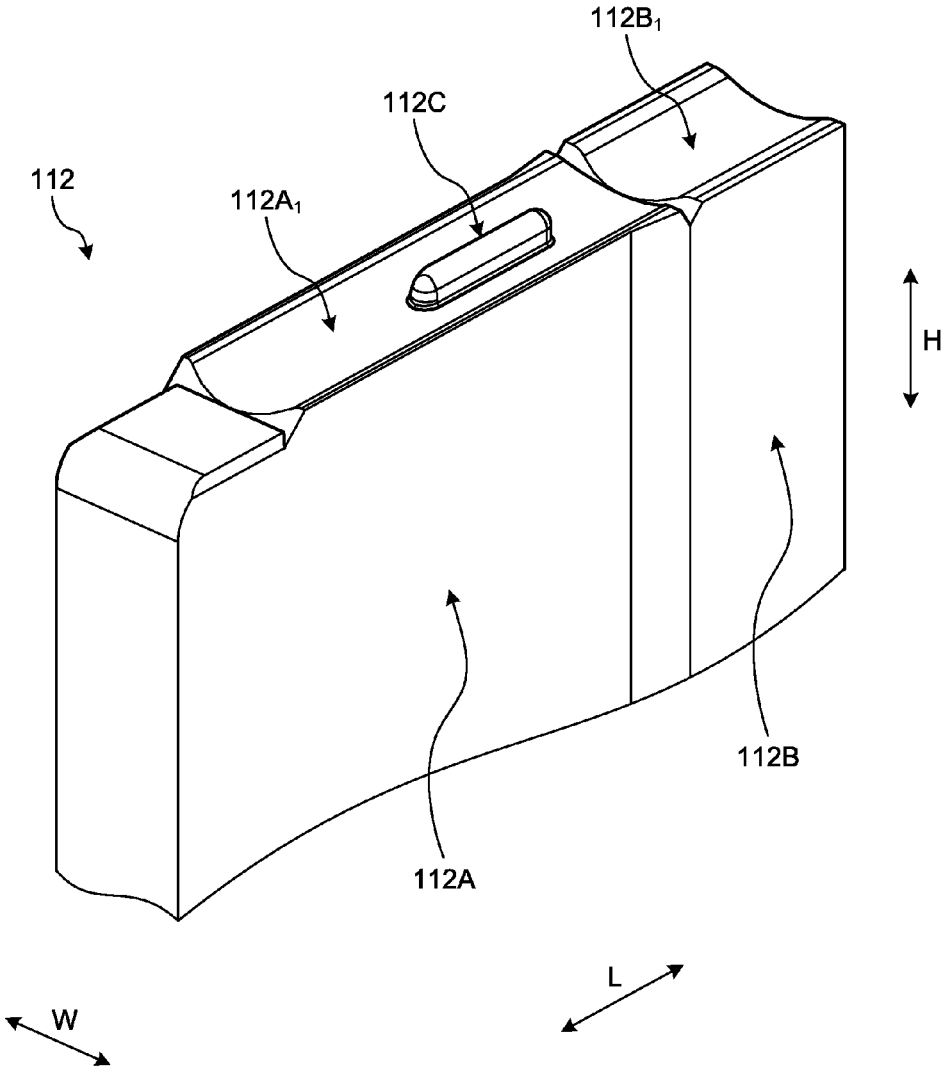
FIG. 25 is a perspective view of a first metal mold according to the second example of the embodiment.
Figure 26:
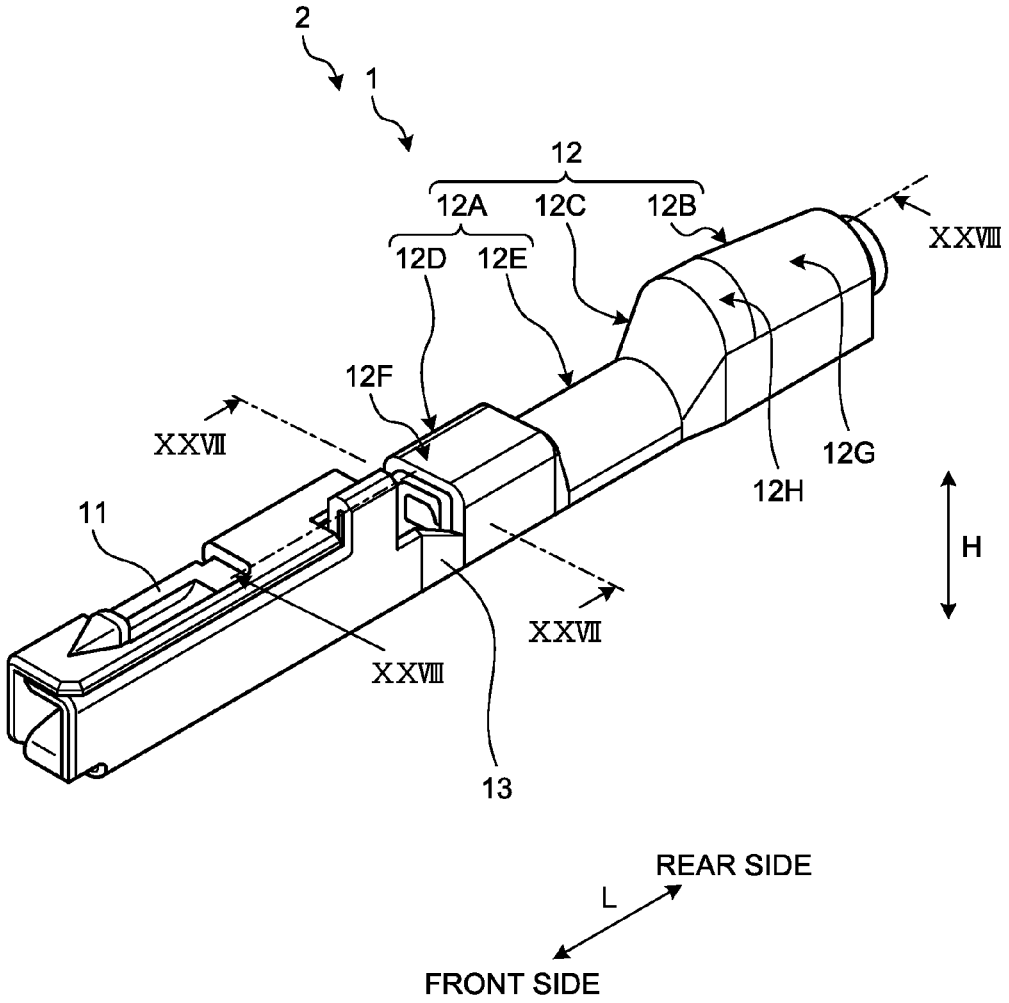
FIG. 26 is a perspective view of an electric wire with a terminal according to the second example of the embodiment.
Figure 27:
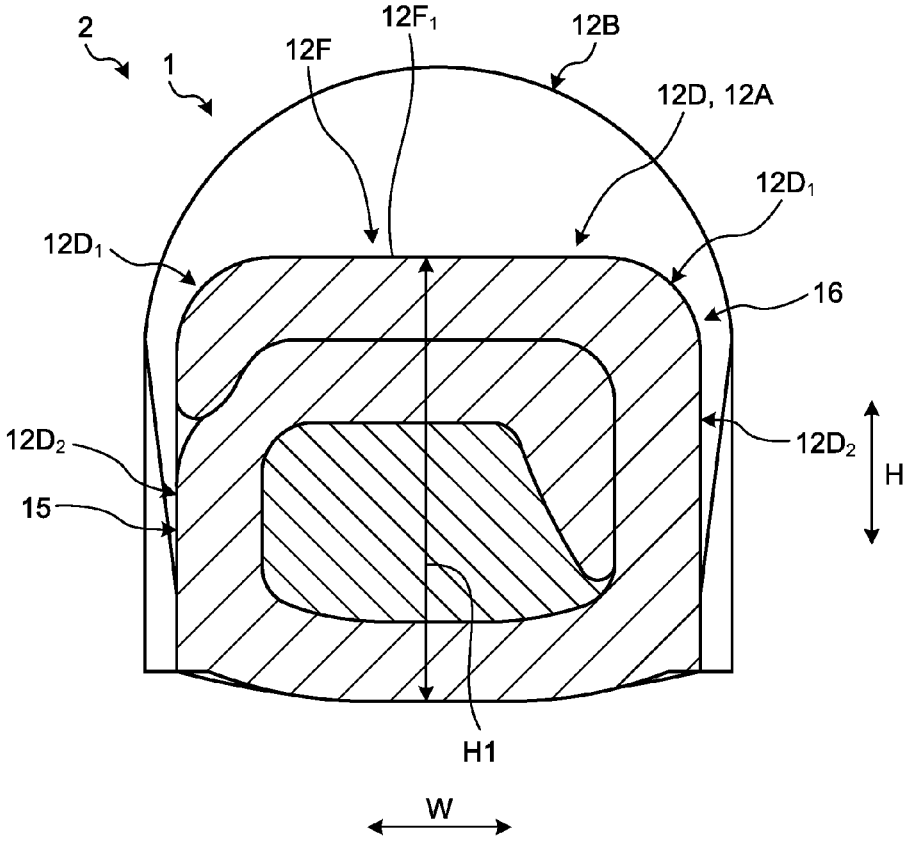
FIG. 27 is a sectional view of the electric wire with a terminal according to the second example of the embodiment.
Figure 28:
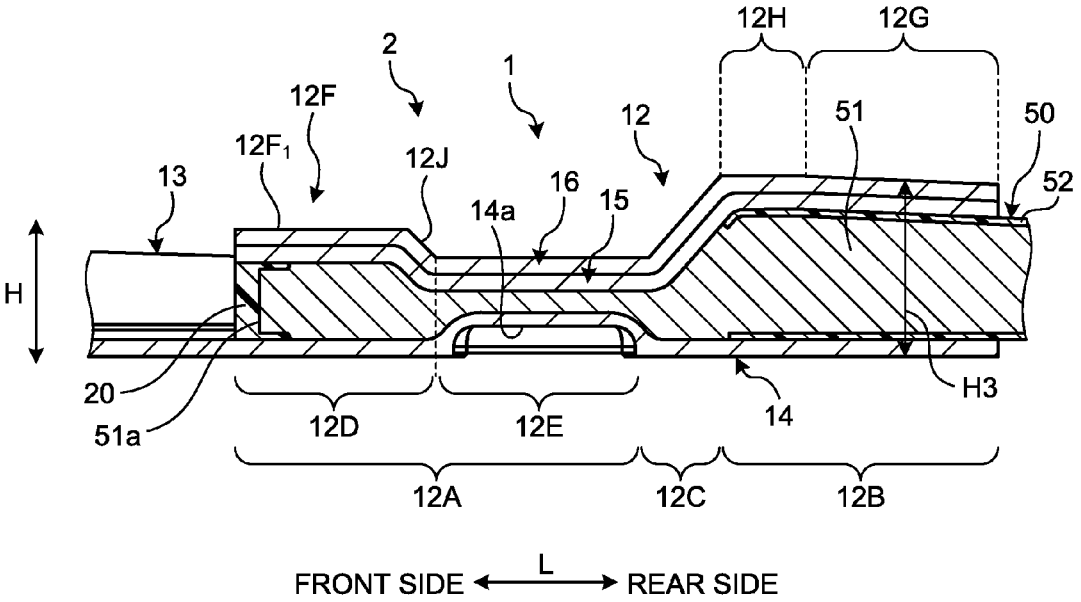
FIG. 28 is another sectional view of the electric wire with a terminal according to the second example of the embodiment.

A second example of the embodiment will be described with reference to FIG. 22 to FIG. 28. FIG. 22 is a front view of a second metal mold according to the second example of the embodiment, FIG. 23 is a perspective view of the second metal mold according to the second example of the embodiment, FIG. 24 is a sectional view of the second metal mold according to the second example of the embodiment, FIG. 25 is a perspective view of a first metal mold according to the second example of the embodiment, FIG. 26 is a perspective view of an electric wire with a terminal according to the second example of the embodiment, FIG. 27 is a sectional view of the electric wire with a terminal according to the second example of the embodiment, FIG. 28 is another sectional view of the electric wire with a terminal according to the second example of the embodiment. FIG. 24 illustrates a sectional surface taken along line XXIV-XXIV of FIG. 22. FIG. 27 illustrates a sectional surface taken along line XXVII-XXVII of FIG. 26. FIG. 28 illustrates a sectional surface taken along line XXVIII-XXVIII of FIG. 26.

In the second example of the embodiment, the diameter expansion portion 113C of the second metal mold 113 includes a plane portion 117$A_1$. As illustrated in FIG. 22 and FIG. 24, the plane portion 117$A_1$ is a plane surface facing the first metal mold 112 in the third direction H. The plane portion 117$A_1$, for example, is a surface parallel to the second direction W. The plane portion 117$A_1$ may be parallel to the first direction L. The plane portion 117$A_1$ of the second example is a surface parallel to each of the first direction L and the second direction W. Accordingly, the plane portion 117$A_1$ is a surface orthogonal to a movement direction of the second metal mold 113.

As illustrated in FIG. 22, the plane portion 117$A_1$ is a part of the third wall surface 117. The step portion 117A of the third wall surface 117 includes a plane portion 117$A_1$, a first curved portion 117$A_2$, and a second curved portion 117$A_3$. The first curved portion 117$A_2$ joins the plane portion 117$A_1$ and the first wall surface 115 together. The second curved portion 117$A_3$ joins the plane portion 117$A_1$ and the second wall surface 116 together. Each of the first curved portion 117$A_2$ and the second curved portion 117$A_3$ is a concave curved surface. The curved shape of the curved portions 117$A_2$ and 117$A_3$ in a case of being seen from the first direction L, for example, is an arced shape. As illustrated in FIG. 23, each of the plane portion 117$A_1$, the first curved portion 117$A_2$, and the second curved portion 117$A_3$ extends towards the portion 113D on the base end side along the first direction L.

As illustrated in FIG. 25, the first metal mold 112 of the second example includes a protrusion 112C. The protrusion 112C protrudes from the concave surface 112$A_1$ of the first anvil 112A. The protrusion 112C is disposed in the center portion of the concave surface 112$A_1$ in the second direction W. The protrusion 112C extends along the first direction L. A range of the protrusion 112C in the first direction L corresponds to a range in which the core 51 of the electric wire 50 is provided. The compression rate of the electric wire 50 with respect to the core 51 increases, and thus, the protrusion 112C accelerates the adhesion between the core 51 and the core crimping unit 12A.

As illustrated in FIG. 24, the diameter expansion portion 113C is positioned on the front side from the protrusion 112C in the first direction L. In the description of the second metal mold 113, the "front side" represents the first crimper 113A side seen from the second crimper 113B, and the "rear side" represents the second crimper 113B side seen from the first crimper 113A. The front side and the rear side correspond to the front side and the rear side of the crimping terminal 1 described below. In the first direction L, a range R1 where the diameter expansion portion 113C extends is separated from a range R2 where the protrusion 112C extends to the front side by only a predetermined distance. Such a distance is determined such that the adhesion accelerating effect of the protrusion 112C does not decrease. In the third wall surface 117, a rear end portion of the diameter expansion portion 113C forms an inclined portion 117$A_4$ joined to the portion 113D on the base end side.

FIG. 26 to FIG. 28 illustrate the electric wire 2 with a terminal manufactured by the first metal mold 112 and the second metal mold 113 according to the second example. In the electric wire connection portion 12, the core crimping unit 12A includes the diameter expansion portion 12D and the portion 12E on the base end side. The diameter expansion portion 12D is a portion which is crimped by the diameter expansion portion 113C of the second metal mold 113. The portion 12E on the base end side is a portion which is crimped by the portion 113D of the second metal mold 113 on the base end side. The shape of the concave portion 113$A_1$ of the first crimper 113A is transferred to the core crimping unit 12A. In other words, the shape of the core crimping unit 12A of the electric wire 2 with a terminal is a shape according to the shape of the concave portion 113$A_1$.

As illustrated in FIG. 26 to FIG. 28, the diameter expansion portion 12D includes a flat portion 12F. As illustrated in FIG. 27, the flat portion 12F faces the bottom portion 14 in the third direction H. An outside surface 12$F_1$ of the flat portion 12F is parallel to the second direction W. The shape of the outside surface 12$F_1$ corresponds to a shape according to the shape of the plane portion 117$A_1$ of the first metal mold 112. As illustrated in FIG. 28, the outside surface 12$F_1$ is parallel to the first direction L. That is, in the electric wire 2 with a terminal of the second example, the outside surface 12$F_1$ is a plane surface orthogonal to the third direction H.

As illustrated in FIG. 28, a recess portion 14*a* is formed in the bottom portion 14. The recess portion 14*a* is formed by the protrusion 112C of the first metal mold 112. The recess portion 14*a* is formed in the portion 12E on the base end side. The recess portion 14*a* is recessed towards the core 51 side. The recess portion 14*a* is a groove which extends along the first direction L. The diameter expansion portion 12D is separated from the recess portion 14*a* in the first direction L. The diameter expansion portion 12D is positioned on the front side from the front end of the recess portion 14*a*. The water stop member 20 covers the tip end 51*a* of the core 51, and blocks the opening of the core crimping unit 12A on the joining portion 13 side. The diameter expansion portion 12D contains the water stop member 20.

In the second metal mold 113, the plane portion 117$A_1$ is disposed in the diameter expansion portion 113C, and thus, as described below, the electric wire connection portion 12 is prevented from being stretched in the crimping step. By providing the plane portion 117$A_1$, it is possible to increase the sectional area of the diameter expansion portion 113C. That is, it is possible to increase the sectional area of the region surrounded by the first metal mold 112 and the diameter expansion portion 113C at the time of crimping. As illustrated in FIG. 22, the shape of the step portion 117A is substantially a rectangular shape. As illustrated in FIG. 27, the sectional shape of the diameter expansion portion 12D of the core crimping unit 12A is substantially a rectangular shape, according to the shape of the step portion 117A.

More specifically, the diameter expansion portion 12D includes a side wall portion 12$D_2$ and a curved corner portion 12$D_1$. A pair of side wall portions 12$D_2$ and 12$D_2$ extend towards the flat portion 12F from the bottom portion 14 in the third direction H. The corner portion 12$D_1$ joins the flat portion 12F and the side wall portion 12$D_2$ together. The pair of side wall portions 12$D_2$ and 12$D_2$ face each other in the second direction W, and are substantially parallel to each other. That is, the diameter expansion portion 12D has approximately a constant dimension in the second direction W from the lower end to the upper end in the third direction H. Accordingly, the sectional area of the diameter expansion portion 12D is maximized with respect to the same terminal height H1. Furthermore, the terminal height H1 is the dimension of the crimping terminal 1 after being crimped in the third direction H, that is, a crimping height.

In the crimping step, a volume is absorbed in the corner portion 12$D_1$ of the diameter expansion portion 12D. The volume is absorbed in the corner portion 12$D_1$, and thus, an elongation amount of the electric wire connection portion 12 towards the front side is reduced. As a result thereof, a variation in a length dimension of the crimping terminal 1 is suppressed. In addition, the terminal height H1 is suppressed while the sectional area of the diameter expansion portion 12D is maximized, and thus, a step between the diameter expansion portion 12D and the portion 12E on the base end side is minimized. Accordingly, an inclined angle of an inclined portion 12J (refer to FIG. 28) formed in a rear end portion of the diameter expansion portion 12D moderates, and a decrease in the water stop performance rarely occurs.

The sectional area of the diameter expansion portion 12D increases, and thus, in the crimping step, the elongation amount of the electric wire connection portion 12 or the core 51 towards the first direction L is reduced. The elongation amount of the core 51 is reduced, and thus, a decrease in the water stop performance due to the water stop member 20 is suppressed. In addition, the elongation amount of the electric wire connection portion 12 decreases, and thus, a variation in the elongation amount of the electric wire connection portion 12 in the crimping step decreases. As a result thereof, in the electric wire 2 with a terminal, performance such as fixing properties or a resistance value is stable. In addition, the elongation amount of the core 51 is reduced, and thus, a decrease in the strength of the core 51 rarely occurs.

In addition, the elongation amount of the electric wire connection portion 12 is reduced, and thus, it is possible to downsize the crimping terminal 1 after being crimped. For example, in a case where a connector is required to be downsized, a depth dimension of a terminal containing portion containing the crimping terminal 1 is shortened. As a result thereof, it is considered that a reduction in the length dimension with respect to the crimping terminal 1 after being crimped is required. In a manufacturing method of an electric wire with a terminal of the second example, the diameter expansion portion 113C crimps the electric wire connection portion 12 with respect to the electric wire 50 by the second metal mold 113 including the plane portion 117$A_1$. Accordingly, it is possible to reduce the length dimension of the crimping terminal 1.

In addition, in the second metal mold 113 of the second example, the diameter expansion portion 113C is disposed to be separated from the protrusion 112C in the first direction L. Accordingly, the diameter expansion portion 113C is rarely affected by the adhesion acceleration of the protrusion 112C. Accordingly, it is possible to make ensuring electrical performance of the second metal mold 113 of the second example electric wire 2 with a terminal and stabling of the length dimension of the crimping terminal 1 compatible.

Further, as illustrated in FIG. 24, the second metal mold 113 of the second example includes a joint 117B and an inclined portion 117C. The joint 117B and the inclined portion 117C are disposed in the concave portion 113$B_1$ of the second crimper 113B. The joint 117B and the inclined portion 117C are a part of the third wall surface 117. The joint 117B is positioned on the front side in the first direction L from the inclined portion 117C. The joint 117B joins the joining portion 117D and the inclined portion 117C of the third wall surface 117 together. The joining portion 117D is a portion which crimps the join crimping unit 12C of the electric wire connection portion 12. The joining portion 117D is inclined to be moved away from the first metal mold 112 as being directed towards the second crimper 113B side from the first crimper 113A side along the first direction L.

The inclined portion 117C is inclined to be moved close to the first metal mold 112 as being separated from the first crimper 113A along the first direction L. That is, an interval H2 between the inclined portion 117C and the concave surface 112$B_1$ of the first metal mold 112 in the third direction H decreases as being moved away from the first crimper 113A along the first direction L. The interval H2 in the third direction H, for example, is changed at a constant rate along the first direction L. In the second example, the inclined portion 117C extends to a rear end of the concave portion 113$B_1$. In other words, in the third wall surface 117, the entire portion on the rear side from the joint 117B is the inclined portion 117C. Furthermore, in the second metal mold 113 of the second example, the curved shape of the joint 117B and the curved shape of the inclined portion 117C are common.

By providing the inclined portion 117C, the compression rate with respect to the cover crimping unit 12B increases as being moved away from the first crimper 113A along the first direction L. That is, the inclined portion 117C compresses the cover crimping unit 12B at a high pressure force as being directed towards the rear side.

As illustrated in FIG. 26 and FIG. 28, the cover crimping unit 12B of the electric wire 2 with a terminal includes a taper portion 12G and a joint 12H. The taper portion 12G is a portion which is crimped by the inclined portion 117C of the second metal mold 113. The joint 12H is a portion which is crimped by the joint 117B of the second metal mold 113.

The joint 12H is joined to the join crimping unit 12C. The taper portion 12G is positioned on the rear side in the first direction L from the joint 12H. In the description of the crimping terminal 1, the "front side" is the core crimping unit 12A side seen from the cover crimping unit 12B, and the "rear side" is the cover crimping unit 12B side seen from the core crimping unit 12A. In the taper portion 12G, a terminal height H3 decreases as being directed towards the rear side from the front side. The terminal height H3 is a distance from the outside surface of the bottom portion 14 to the outside surface of the cover crimping unit 12B in the third direction H. On the other hand, in the joint 12H, the terminal height H3 does not fluctuate along the first direction L. In the joint 12H, the terminal height H3 is substantially constant regardless of the position in the first direction L. Accordingly, in the sectional view of FIG. 28, the joint 12H is parallel to the bottom portion 14.

In the sectional surface orthogonal to the second direction W as FIG. 28, the terminal height H3 of the taper portion 12G gradually decreases towards the rear side from the front side. The terminal height H3, for example, is changed at a constant rate along the first direction L. The taper portion 12G is formed in the cover crimping unit 12B, and thus, the crimping strength of the cover crimping unit 12B increases. In other words, in the cover crimping unit 12B, the terminal height H3 decreases as being directed towards the rear side, and thus, a retention force that the cover crimping unit 12B retains the electric wire 50 increases.

The cover crimping unit 12B is crimped by the second metal mold 113 including the inclined portion 117C, and thus, the cover crimping unit 12B is prevented from being stretched. In the crimping step, the second metal mold 113 applies a pressure force larger than the pressure force with respect to a portion of the cover crimping unit 12B on the front side, with respect to the portion of the cover crimping unit 12B on the rear side. Accordingly, the cover crimping unit 12B is prevented from being stretched. In addition, as illustrated in FIG. 24, the interval H2 between the inclined portion 117C and the concave surface 112$B_1$ is narrowed as being directed towards the rear side along the first direction L. In other words, a sectional area of a space surrounded by the inclined portion 117C and the concave surface 112$B_1$ is narrowed as being directed towards the rear side along the first direction L. Accordingly, in the crimping step, even in a case where the cover crimping unit 12B is stretched towards the rear side, the stretching is suppressed.

In addition, an inclination direction of the inclined portion 117C is a direction in which the cover crimping unit 12B is prevented from being stretched towards the rear side. The inclined portion 117C applies a reactive force towards the front side with respect to the cover crimping unit 12B which is stretched towards the rear side. That is, the inclined portion 117C prevents not only the stretching of the cover crimping unit 12B due to the frictional force but also the stretching of the cover crimping unit 12B due to the reactive force towards the front side. Thus, the second metal mold 113 of the second example is capable of preventing the cover crimping unit 12B from being stretched towards the rear side of the first direction L.

In addition, as described above, the cover crimping unit 12B crimped by the second metal mold 113 of the second example includes the taper portion 12G. The crimping terminal 1 in which the taper portion 12G is formed in the cover crimping unit 12B represents that the cover crimping unit 12B is prevented from being stretched in the crimping step. That is, the second metal mold 113 of the second example, the manufacturing method of an electric wire with a terminal using the second metal mold 113, and the electric wire 2 with a terminal have the common effect that the cover crimping unit 12B is prevented from being stretched.

In addition, in the electric wire 2 with a terminal including the joint 12H, a decrease in the water stop performance rarely occurs. An electric wire with a terminal in which the joint 12H is not provided, and the join crimping unit 12C and the taper portion 12G are directly joined together, is set as a comparative example. In the electric wire with a terminal of the comparative example, the barrel piece portions 15 and 16 are bent at a steep angle in a joint between the join crimping unit 12C and the taper portion 12G. As a result thereof, a gap is generated between the first barrel piece portion 15 and the second barrel piece portion 16, and thus, a decrease in the water stop performance is easily caused. In contrast, the cover crimping unit 12B of the second example includes the joint 12H, and thus, a bending angle between the barrel piece portions 15 and 16 becomes a small angle. As a result thereof, in the electric wire 2 with a terminal of the second example, a decrease in the water stop performance is suppressed.

As described above, the electric wire 2 with a terminal according to this embodiment includes the electric wire 50, and the crimping terminal 1 including the electric wire connection portion 12 which is crimped by being wound around the core 51 and the cover 52 of the electric wire 50. The end portion of electric wire connection portion 12 on the tip end side of the core 51 includes the diameter expansion portion 12D. The diameter expansion portion 12D covers the tip end portion of the core 51, and contains the water stop member 20 sealing the gap between the core 51 and the electric wire connection portion 12. A sectional area of the diameter expansion portion 12D is greater than a sectional area of the portion 12E on the base end side of the core 51 with respect to the diameter expansion portion 12D. In the crimping terminal 1 crimped by the terminal crimping apparatus 100 of this embodiment, the diameter expansion portion 12D is formed, and thus, the elongation amount of the electric wire connection portion 12 decreases, and thus, a variation in the length of the crimping terminal 1 is suppressed. As a result thereof, the electric wire 2 with a terminal according to this embodiment has an effect that a decrease in the performance can be suppressed.

In addition, in the electric wire connection portion 12 of this embodiment, the bottom portion 14 of the portion crimped with respect to the core 51 includes the recess portion 14*a*, which is recessed, on the core 51 side. The diameter expansion portion 12D is separated from the recess portion 14*a* in an axis direction of the electric wire 50. The recess portion 14*a* is formed by the protrusion 112C of the first metal mold 112. The recess portion 14*a* is formed, and thus, the adhesion between the core 51 and the core crimping unit 12A is accelerated. Further, the diameter expansion portion 12D is formed in a portion which is separated from the recess portion 14*a*, and thus, the adhesion accelerating effect of the recess portion 14*a* rarely decreases.

In addition, in the electric wire 2 with a terminal of this embodiment, the diameter expansion portion 12D faces the bottom portion 14 of the crimping terminal 1 in the height direction, and the outside surface 12$F_1$ includes the flat portion 12F which is parallel to the width direction of the bottom portion 14. The sectional area of the diameter expansion portion 12D including the flat portion 12F increases compared to a case where the flat portion 12F is not provided. Accordingly, the diameter expansion portion 12D of this embodiment reduces the elongation amount of the electric wire connection portion 12, and thus, is capable of suppressing a variation in the length of the crimping terminal 1.

In addition, the diameter expansion portion 12D includes the side wall portion 12$D_2$ which extends towards the flat portion 12F from the bottom portion 14 in the height direction, and the curved corner portion 12$D_1$ which joins the flat portion 12F and the side wall portion 12$D_2$ together. Such a diameter expansion portion 12D has a sectional shape which is approximately a rectangular shape. Accordingly, it is possible to maximize the sectional area of the diameter expansion portion 12D while suppressing an increase in a terminal width and a terminal height.

In addition, the manufacturing method of an electric wire with a terminal of this embodiment includes the crimping step. The crimping step is a step in which the electric wire connection portion 12 and the electric wire 50 of the crimping terminal 1 are interposed between the first metal mold 112 and the second metal mold 113 including the concave portions 113$A_1$ and 113$B_1$, and thus, the electric wire connection portion 12 is crimped with respect to the core 51 and the cover 52 of the electric wire 50 by being wound around the core 51 and the cover 52 of the electric wire 50.

In the manufacturing method of an electric wire with a terminal of this embodiment, in the crimping step, the electric wire connection portion 12 is crimped with respect to the electric wire 50 by the second metal mold 113 including the diameter expansion portion 113C. The diameter expansion portion 113C is positioned on the tip end 51*a* side of the core 51 in the concave portion 113$A_1$. The diameter expansion portion 113C includes the plane portion 117$A_1$ facing the first metal mold 112. The electric wire connection portion 12 is crimped with respect to the electric wire connection portion 12 by the second metal mold 113 including the plane portion 117$A_1$, and thus, the diameter expansion portion 12D including the flat portion 12F is formed in the electric wire connection portion 12. As a result thereof, the sectional area of the diameter expansion portion 12D increases, and thus, a variation in the length of the crimping terminal 1 is suppressed.

The terminal crimping apparatus 100 of this embodiment includes the first metal mold 112 and a second metal mold 113. The first metal mold 112 is a lower mold which supports the electric wire connection portion 12 of the crimping terminal 1 by the concave surfaces 112$A_1$ and 112$B_1$. The second metal mold 113 includes the concave portions 113$A_1$ and 113$A_2$. The concave portions 113$A_1$ and 113$A_2$ are upper molds which crimp the electric wire connection portion 12 with respect to the core 51 and the cover 52 of the electric wire 50 by interposing the electric wire connection portion 12 and the electric wire 50 between the first metal mold 112 and by winding the electric wire connection portion 12 around the core 51 and the cover 52 of the electric wire 50.

The diameter expansion portion 113C is disposed in the end portion of the core 51 on the tip end side in the concave portion 113$A_1$. In the diameter expansion portion 113C, the sectional area of the space surrounded by the concave portion 113$A_1$ and the first metal mold 112 is large compared to the portion 113D on the base end side of the core 51 with respect to the diameter expansion portion 113C. Accordingly, when the core crimping unit 12A is crimped with respect to the core 51, the terminal crimping apparatus 100 of this embodiment sets the degree of the compression in the end portion of the core 51 on the tip end side to be lower than the degree of the compression in the other portion.

Accordingly, the terminal crimping apparatus 100 of this embodiment is capable of suppressing the protrusion of the core 51 from the core crimping unit 12A or the excessive protrusion of the water stop member 20. By decreasing the degree of the compression in the diameter expansion portion 113C, it is possible to interpose a sufficient amount of water stop member 20 between the core 51 and the core crimping unit 12A after the crimping is completed. In addition, the sectional area increases in the diameter expansion portion 113C, and thus, interference between the first barrel piece portion 15 and the second barrel piece portion 16 at the time of being wound around the electric wire 50 is suppressed. In addition, by providing the diameter expansion portion 113C, the elongation amount of the electric wire connection portion 12 is reduced. As a result thereof, a variation in the length of the crimping terminal 1 is suppressed.

In addition, in the diameter expansion portion 113C, the concave portion 113$A_1$ is recessed towards a side opposite to the first metal mold 112 compared to the portion 113D of the core 51 on the base end side. The step portion 117A, which is recessed towards the side opposite to the first metal mold 112, is disposed in the third wall surface 117. The step portion 117A has an escaping structure at the time of crimping, and allows the escape of the compressed core crimping unit 12A or the core 51. The concave portion 113$A_1$ is recessed towards the side opposite to the first metal mold 112, and thus, it is possible to suitably suppress the protrusion of the core 51 from the core crimping unit 12A and the excessive protrusion of the water stop member 20. In addition, the concave portion 113$A_1$ is recessed towards the side opposite to the first metal mold 112, and thus, a variation in the length of the crimping terminal 1 is suppressed.

Furthermore, the material of the core 51 of the electric wire 50 is not limited to aluminum. The core 51, for example, may be copper or a copper alloy, or may be other metals having conductivity or the like. The material of the crimping terminal 1 is not limited to copper or a copper alloy, and may be other metals having conductivity.

The position and the shape of the taper portion 12G of the second example are not limited to the exemplified position and shape. For example, a portion in which the terminal height H3 does not fluctuate may be disposed on the rear side from the taper portion 12G. In the sectional surface illustrated in FIG. 28, the shape of the taper portion 12G may not be a linear shape. For example, a sectional shape of the taper portion 12G may be a shape curved towards the bottom portion 14 side or a shape curved towards a side opposite to the bottom portion 14 side. In addition, the taper portion 12G may be curved in the middle of the first direction L. For example, the sectional shape of the taper portion 12G may be V-shaped.

First Modification Example of Embodiment

Figure 29:
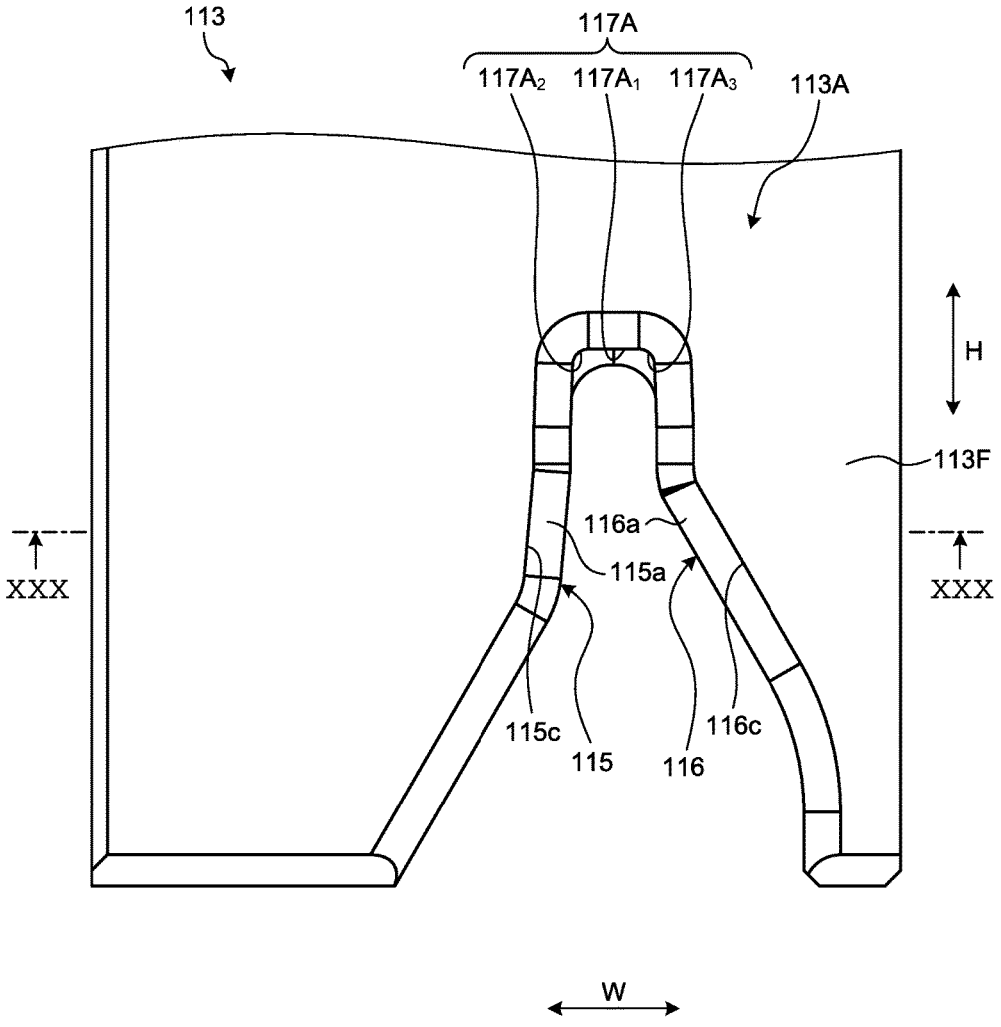
FIG. 29 is a front view of a second metal mold according to a first modification example of the embodiment.
Figure 30:
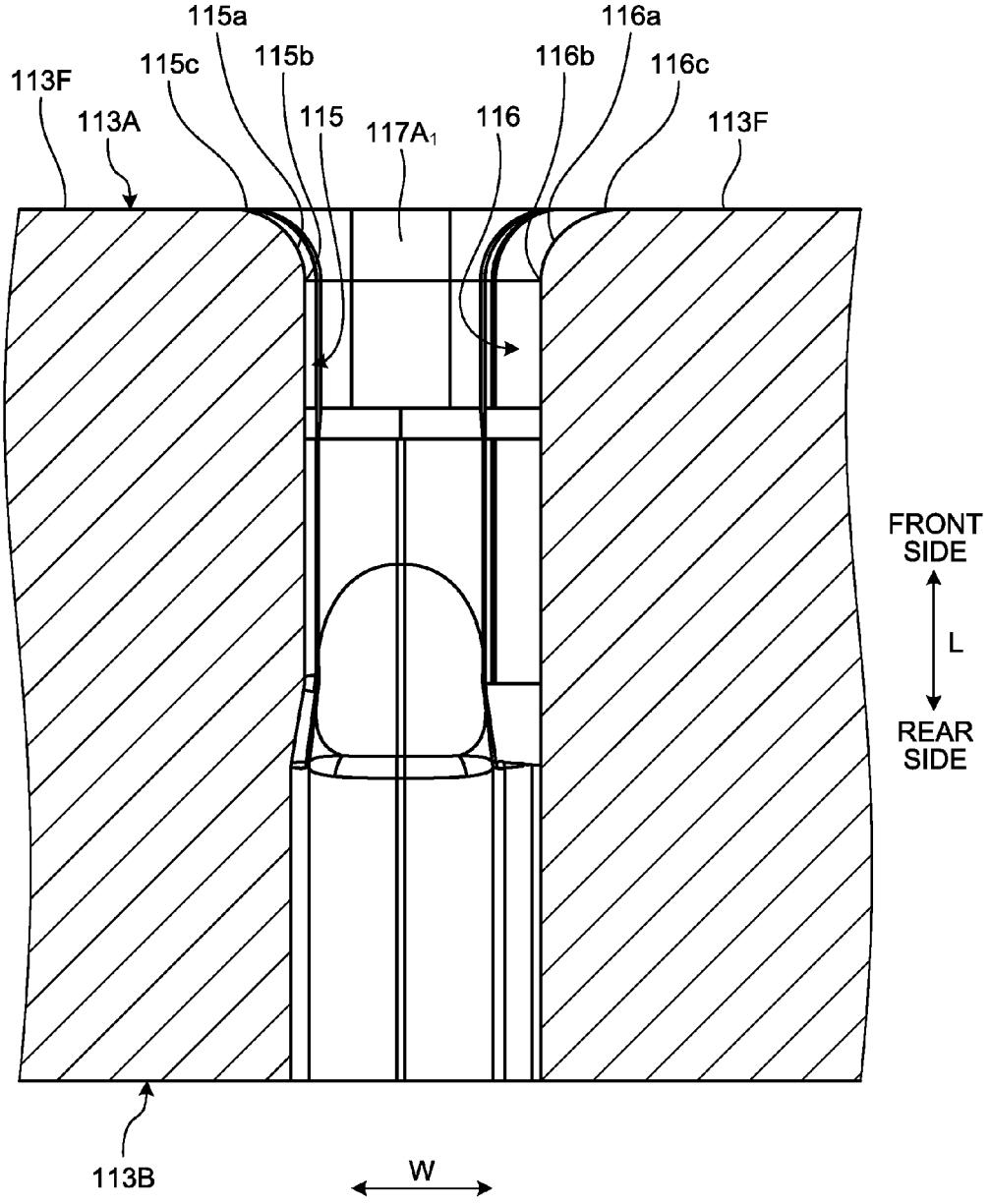
FIG. 30 is a sectional view of the second metal mold according to the first modification example of the embodiment.
Figure 31:
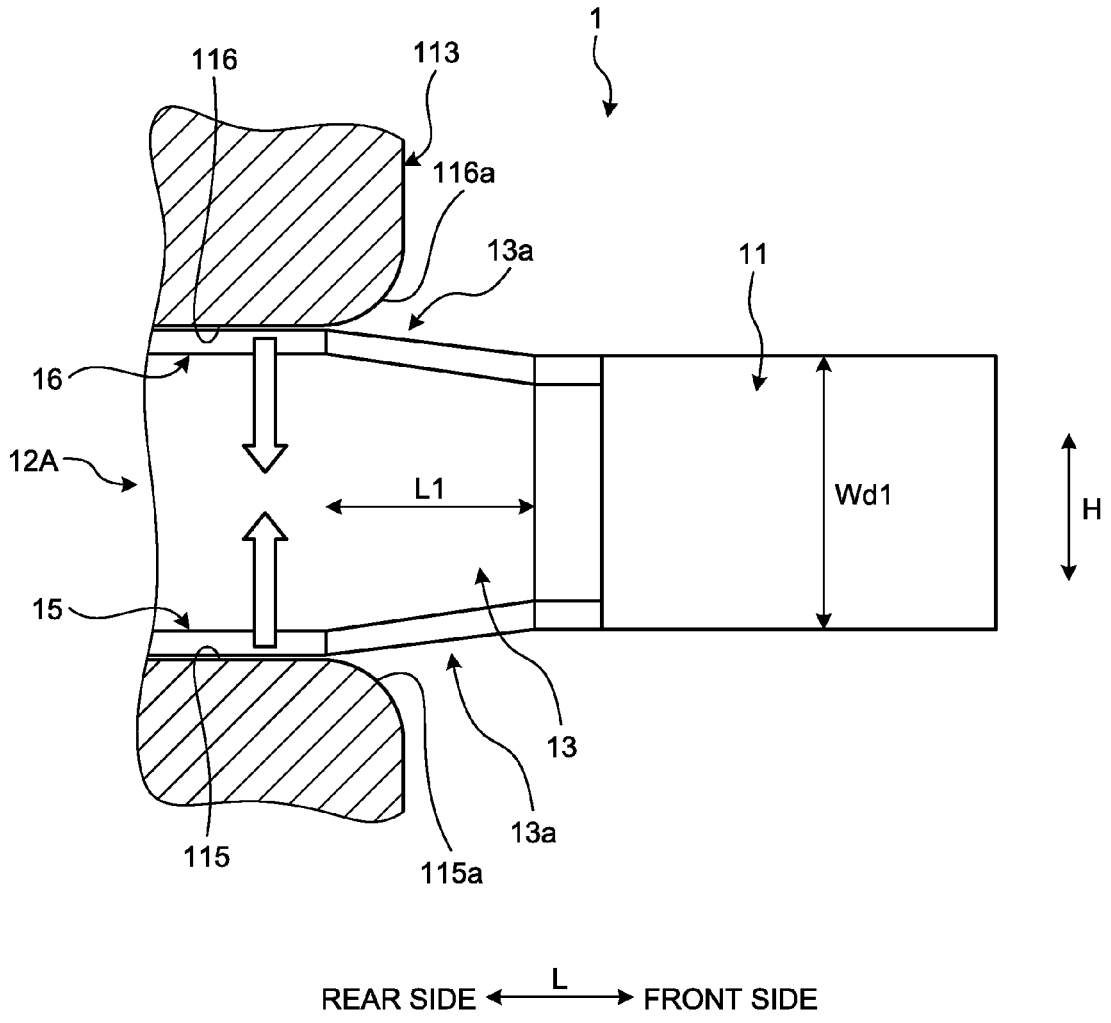
FIG. 31 is a diagram illustrating an operation at the time of crimping.

A first modification example of the embodiment will be described. FIG. 29 is a front view of a second metal mold according to the first modification example of the embodiment, FIG. 30 is a sectional view of the second metal mold according to the first modification example of the embodiment, and FIG. 31 is a diagram illustrating an operation at the time of crimping. FIG. 30 illustrates a sectional surface taken along line XXX-XXX of FIG. 29. In a second metal mold 113 of the first modification example, a difference from the second metal mold 113 of the embodiment described above is that the shape of the front end of the first wall surface 115 and the second wall surface 116 is curved. The second metal mold 113 according to the first modification example suppresses the occurrence of chipping of the joining portion 13.

As illustrated in FIG. 29 and FIG. 30, each of curved portions 115*a* and 116*a* is disposed on the front end of the first wall surface 115 and the second wall surface 116. The curved portions 115*a* and 116*a* are joined to a front surface 113F of the second metal mold 113. The front surface 113F is an end surface of the second metal mold 113 on the first crimper 113A side. A tangent direction in one ends 115*b* and 116*b* of the curved portions 115*a* and 116*a* is a first direction L. A tangent direction in the other ends 115*c* and 116*c* of the curved portions 115*a* and 115*b* is a second direction W. That is, the curved portions 115*a* and 115*b* are formed such that an edge is not generated on both ends.

As illustrated in FIG. 31, in the crimping step, the first wall surface 115 presses the first barrel piece portion 15 towards the second barrel piece portion 16 side, and the second wall surface 116 presses the second barrel piece portion 16 towards the first barrel piece portion 15 side. Here, the first wall surface 115 and the second wall surface 116 of the first modification example respectively include the curved portions 115*a* and 116*a*. It is difficult for the curved portions 115*a* and 116*a* to damage the side wall 13*a* even in a case of being in contact with the side wall 13*a* of the joining portion 13. Accordingly, the second metal mold 113 of the first modification example is capable of suppressing a decrease in the strength of the joining portion 13.

In a case where the curved portions 115*a* and 116*a* are not disposed in the second metal mold 113, the side wall 13*a* is easily damaged by the front end of the second metal mold 113 as a width Wd1 of the terminal connection portion 11 increases. In addition, the side wall 13*a* is easily damaged by the front end of the second metal mold 113 as a length L1 of the joining portion 13 is reduced. In contrast, the second metal mold 113 of the first modification example includes the curved portions 115*a* and 116*a*. The second metal mold 113 of the first modification example is capable of increasing the width Wd1 while suppressing the damage with respect to the side wall 13*a* or of reducing the length L1 of the joining portion 13 while suppressing the damage with respect to the side wall 13*a*.

Second Modification Example of Embodiment

A second modification example of the embodiment will be described. The water stop member 20 may not protrude from the electric wire connection portion 12 after being crimped. The water stop member 20 may not protrude from the electric wire connection portion 12 insofar as the water stop member 20 covers the tip end of the core 51, and suitably seals a gap between the core 51 and the electric wire connection portion 12.

The shape of the diameter expansion portion 113C is not limited to the exemplified shape. For example, the diameter expansion portion 113C may be formed such that the sectional area of the space surrounded by the concave portion 113$A_1$ and the first metal mold 112 gradually increases as being directed towards the tip end side of the core 51. In contrast, the diameter expansion portion 113C may be formed such that the sectional area of the space surrounded by the concave portion 113$A_1$ and the first metal mold 112 gradually decreases as being directed towards the tip end side of the core 51.

In addition, in the diameter expansion portion 113C, in a plurality of step portions 117A may be disposed in the third wall surface 117. In this case, it is desirable that the sectional area of the space surrounded by the concave portion 113$A_1$ and the first metal mold 112 gradually increases along the first direction L. In the front view, the shape of the step portion 117A is not limited to an arc shape. The shape of the step portion 117A, for example, may be a multiangular shape.

The contents disclosed in the embodiment and the modification examples described above can be executed by being suitably combined.

An electric wire with a terminal according to the present embodiment, includes: an electric wire; and a crimping terminal including an electric wire connection portion crimped by being wound around a core and a cover of the electric wire. In an end portion of the electric wire connection portion on a tip end side of the core, a diameter expansion portion which contains a water stop member covering a tip end portion of the core and sealing a gap between the core and the electric wire connection portion is provided, and a sectional area of the diameter expansion portion is greater than a sectional area of a portion on the base end side of the core with respect to the diameter expansion portion. According to the electric wire with a terminal of the present embodiment, the diameter expansion portion is provided, and thus, an elongation amount of the electric wire connection portion is reduced. A variation in a length dimension is suppressed according to a reduction in the elongation amount of the electric wire connection portion, and thus, a performance degradation of the electric wire with a terminal is suppressed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An electric wire with a terminal, comprising:

an electric wire;

a crimping terminal including an electric wire connection portion crimped by being wound around a core and a cover of the electric wire, wherein a diameter expansion portion is provided in an end portion of the electric wire connection portion on a tip end side of the core, a sectional area of the electric wire connection portion at the diameter expansion portion is greater than a sectional area of the electric wire connection portion at a portion on a base end side of the core with respect to the diameter expansion portion, the electric wire connection portion includes a bottom wall portion, and a pair of swaging pieces respectively protruding from both ends of the bottom wall portion in a width direction, the pair of swaging pieces include a first swaging piece wound around the core and the cover, and a second swaging piece wound around an outside of the first swaging piece in a superposed manner, a tip end of the first swaging piece is separated from the bottom wall portion in the diameter expansion portion, the diameter expansion portion includes a flat portion which faces the bottom wall portion in a height direction of the crimping terminal, and of which an outside surface is parallel to the bottom wall portion in the width direction, the outside surface of the flat portion is parallel to the electric wire in an axis direction, the diameter expansion portion includes a side wall portion extending towards the flat portion from the bottom wall portion in the height direction, and a curved corner portion joining the flat portion and the side wall portion together, in the electric wire connection portion, the bottom wall portion of the portion crimped with respect to the core includes a recess portion which is recessed towards the core side, and the diameter expansion portion is separated from the recess portion in the axis direction of the electric wire.

2. The electric wire with the terminal according to claim 1, further comprising:

a water stop member covering a tip end portion of the core and sealing a gap between the core and the electric wire connection portion.

3. A method for manufacturing an electric wire with a terminal, comprising:

a crimping step of crimping an electric wire connection portion of a crimping terminal by interposing the electric wire connection portion and an electric wire between a first metal mold and a second metal mold including a concave portion and by winding the electric wire connection portion around a core and a cover of the electric wire, wherein in the crimping step, the electric wire connection portion is crimped with respect to the electric wire by the second metal mold including a diameter expansion portion in an end portion of the concave portion on a tip end side of the core, and a plane portion in which the diameter expansion portion faces the first metal mold, the electric wire connection portion includes a bottom wall portion, and a pair of swaging pieces respectively protruding from both ends of the bottom wall portion in a width direction, the pair of swaging pieces include a first swaging piece wound around the core and the cover, and a second swaging piece wound around an outside of the first swaging piece in a superposed manner, a tip end of the first swaging piece is separated from the bottom wall portion in the diameter expansion portion, the diameter expansion portion includes a flat portion which faces the bottom wall portion in a height direction of the crimping terminal, and of which an outside surface is parallel to the bottom wall portion in the width direction, the outside surface of the flat portion is parallel to the electric wire in an axis direction, the diameter expansion portion includes a side wall portion extending towards the flat portion from the bottom wall portion in the height direction, and a curved corner portion joining the flat portion and the side wall portion together, in the electric wire connection portion, the bottom wall portion of the portion crimped with respect to the core includes a recess portion which is recessed towards the core side, and the diameter expansion portion is separated from the recess portion in the axis direction of the electric wire.

* * * * *